US006889141B2

(12) United States Patent
Li et al.

(10) Patent No.: US 6,889,141 B2
(45) Date of Patent: May 3, 2005

(54) METHOD AND SYSTEM TO FLEXIBLY CALCULATE HYDRAULICS AND HYDROLOGY OF WATERSHEDS AUTOMATICALLY

(76) Inventors: Weimin Li, 5840 Gulfton Dr. #1780, Houston, TX (US) 77081; Qian Gao, 5840 Gulfton Dr. #1780, Houston, TX (US) 77081

( * ) Notice: Subject to any disclaimer, the term of this patent is extended or adjusted under 35 U.S.C. 154(b) by 153 days.

(21) Appl. No.: 10/338,995

(22) Filed: Jan. 10, 2003

(65) Prior Publication Data

US 2004/0138815 A1 Jul. 15, 2004

(51) Int. Cl.[7] ..... G01V 3/00; E02B 13/00
(52) U.S. Cl. ..... 702/2; 405/36
(58) Field of Search ..... 702/2; 405/39, 405/36

(56) References Cited

U.S. PATENT DOCUMENTS 5,323,317 A * 6/1994 Hampton et al. ..... 702/3
5,342,144 A * 8/1994 McCarthy ..... 405/39

OTHER PUBLICATIONS

Olivera et al., System of GIS–Based Hydrologic and Hydraulic Applications for Highway Engineering: Summary Report, Oct. 1999, Bureau of Engineering Research: The University of Texas at Austin.*

Maidment et al., GIS for Floodplain Mapping in Design of Highway Drainage Facilities, Aug. 1998, Bureau of Engineering Research: The University of Texas at Austin.*

Tate, Floodplain Mapping and terrain Modeling Using HEC–RAS and ArcView GIS, Apr. 1999, Center for Research in Water Resources.*

State Standard for Floodplain Hydraulic Modeling, Jul. 2002, Arizona Department of Water Resources Dam Safety Section.*

* cited by examiner

*Primary Examiner*—John Barlow
*Assistant Examiner*—Toan M. Le

(57) ABSTRACT

A method and system for calculating hydraulics and hydrology of watersheds automatically with flexibility. It combines the concepts of hydraulics and hydrology with the flexibility of spreadsheets and the automation of the accompanied standalone computer modules created in this new system. Each standalone module functions as a control center to communicate with other application programs like EXCEL and process the input data, to perform the calculation internally and place results in a popularly adopted format like spreadsheet. One control center relays information to others through linking the input and output data sources. A seamless stream of calculation can be formed flexibly by repeating the above linking procedure. This optimized calculation stream and the new computer functions created in them have eliminated many tedious and labor-intensive tasks. The modules are self-contained, which means easy maintenance and error proof compared with the scripts if any embedded in spreadsheets.

16 Claims, 32 Drawing Sheets

420

| Reach Name | HEC-RAS Cross Section NO. | HEC-HMS Node Name |
|---|---|---|
| Lower spruce | 0.000 | nodeB |
| Lower spruce | 465.000 | nodeA |
| middle spruce | 1050.000 | third |
| middle spruce | 1405.000 | second |
| middle spruce | 1960.000 | first |

430

| Reach Name : lower spruce | | | | | |
|---|---|---|---|---|---|
| Stations | Average Slope | Average Slope | From this column are all the length-weighted | | |
| | (%) | (ft/mile) | conveyance Pecentage (%) | | |
| 0 - 465 | 0.053 | 2.78 | 99.16 | 90.35 | 88.03 |
| | | | | | |
| Reach Name : middle spruce | | | | | |
| Stations | Average Slope | Average Slope | From this column are all the length-weighted | | |
| | (%) | (ft/mile) | conveyance Pecentage (%) | | |
| 1050 - 1405 | 0.152 | 8.00 | 100.00 | 99.08 | 96.58 |
| 1405 - 1960 | 0.129 | 6.83 | 100.00 | 99.22 | 96.05 |

440

| Reach Name : lower spruce ********** | | | | | |
|---|---|---|---|---|---|
| SV | SQ | Travel Time (hour) | | | |
| rt_nodeA-nodeB | | Stations 0 - 465 | | | |
| 0 | 0 | | | | |
| 2.52 | 300 | | 0.1 | | |
| 5.77 | 800 | | 0.08 | | |
| 6.88 | 1000 | | 0.08 | | |
| | | | | | |
| Reach Name : lower spruce ---------- | | | | | |
| | | | | | |
| Routing_Reach | Incremental Travel Time For All Profiles, P1 to Pn, | | | | |
| | the last two are average time and time steps | | | | |
| rt_nodeA-nodeB | 0.1 | 0.08 | 0.08 | 0.087 | 1 |
| | | | | | |
| Reach Name : middle spruce ********** | | | | | |
| SV | SQ | Travel Time (hour) | | | |
| rt_second-third | | Stations 1050 - 1405 | | | |
| 0 | 0 | | | | |
| 0.7 | 170 | | 0.05 | | |
| 1.37 | 450 | | 0.04 | | |
| 1.8 | 560 | | 0.04 | | |
| | | | | | |
| rt_first-second | | Stations 1405 - 1960 | | | |
| 0 | 0 | | | | |
| 0.9 | 170 | | 0.06 | | |
| 1.89 | 450 | | 0.05 | | |
| 2.55 | 560 | | 0.05 | | |
| | | | | | |
| Reach Name : middle spruce ---------- | | | | | |
| | | | | | |
| Routing_Reach | Incremental Travel Time For All Profiles, P1 to Pn, | | | | |
| | the last two are average time and time steps | | | | |
| rt_second-third | 0.05 | 0.04 | 0.04 | 0.043 | 1 |
| rt_first-second | 0.06 | 0.05 | 0.05 | 0.053 | 1 |

FIG. 4C

475

| Subbasin Name | Subbasin Area (mi^2) | Subbasin Development Percentage (%) | Corresponding HMS Node Name |
|---|---|---|---|
| G10333A | 5.71 | 24.2 | G10333A |
| G10333B | 2.29 | 37.7 | g10333#2 |
| G10333C | 1.31 | 13.5 | g10333#3 |
| G10333D | 0.43 | 55.4 | g10333#4U |
| G10333E | 1.32 | 81.3 | g10333E |
| G10333F | 0.40 | 60.8 | g10333#5 |
| G10333G | 0.26 | 53.1 | g10333#6U |
| G10333H | 1.13 | 68.5 | G10333H |
| G10333I | 0.25 | 22.8 | g10333#7 |
| G10333J | 1.55 | 46.9 | g10333#8 |
| G10333K | 1.68 | 62.5 | g10333#9 |

476

| Subbasin Name | Corresponding HMS Node | Cumulative Area (acre) | Cumulative Development percentage (%) |
|---|---|---|---|
| G10333A | G10333A | 3654.4 | 24.2 |
| G10333B | g10333#2 | 5120.0 | 28.1 |
| G10333C | g10333#3 | 5958.4 | 26.0 |
| G10333D | g10333#4U | 6233.6 | 27.3 |
| G10333E | g10333E | 844.8 | 81.3 |
| G10333F | g10333#5 | 7334.4 | 34.7 |
| G10333G | g10333#6U | 7500.8 | 35.1 |
| G10333H | G10333H | 723.2 | 68.5 |
| G10333I | g10333#7 | 8384.0 | 37.7 |
| G10333J | g10333#8 | 992.0 | 46.9 |
| G10333K | g10333#9 | 2067.2 | 55.0 |

FIG. 4G-1

477

| Channel Slope (ft/mi) | Development (%) | Area (acres) | Flow Rates (cfs) | Description |
|---|---|---|---|---|
| 6.7 | 24 | 3654 | 2879 | G10333A |
| 10.0 | 28 | 5120 | 4273 | G10333B |
| 5.0 | 26 | 5958 | 3794 | G10333C |
| 6.5 | 27 | 6234 | 4346 | G10333D |
| 14.1 | 81 | 845 | 2088 | G10333E |
| 8.5 | 35 | 7334 | 5853 | G10333F |
| 4.2 | 35 | 7501 | 4907 | G10333G |
| 23.8 | 68 | 723 | 2153 | G10333H |
| 3.4 | 38 | 8384 | 5300 | G10333I |
| 2.1 | 31 | 6112 | 3328 | G10333J |
| 3.7 | 36 | 7187 | 4682 | G10333K |

FIG. 4G-2

520

| GAGE ID : | O100D | | |
|---|---|---|---|
| Time Interval | 15 | minutes | |
| Start Date | 34622 | Start Time | 0 |
| End Date | 34626 | End Time | 2345 |
| Gage ID | Date | Time | Gage Data |
| O100D | 34622 | 0 | 0 |
| O100D | 34622 | 15 | 0 |
| O100D | 34622 | 30 | 0 |
| O100D | 34622 | 45 | 0 |
| O100D | 34622 | 100 | 0 |
| O100D | 34622 | 115 | 0 |
| O100D | 34622 | 130 | 0.001 |
| O100D | 34622 | 145 | 0.005 |
| O100D | 34622 | 200 | 0.001 |
| O100D | 34622 | 215 | 0.002 |
| O100D | 34622 | 230 | 0.004 |
| O100D | 34622 | 245 | 0.004 |
| O100D | 34622 | 300 | 0.004 |
| O100D | -------- | ----- | ------ |
| O100D | 34626 | 2345 | 0 |

521

| GAGE ID : | O107 | | |
|---|---|---|---|
| Time Interval | 15 | minutes | |
| Start Date | 34622 | Start Time | 0 |
| End Date | 34626 | End Time | 2345 |
| Gage ID | Date | Time | Gage Data |
| O107 | 34622 | 0 | 0 |
| O107 | 34622 | 15 | 0 |
| O107 | 34622 | 30 | 0 |
| O107 | 34622 | 45 | 0 |
| O107 | 34622 | 100 | 0 |
| O107 | 34622 | 115 | 0 |
| O107 | 34622 | 130 | 0.003 |
| O107 | 34622 | 145 | 0 |
| O107 | 34622 | 200 | 0 |
| O107 | 34622 | 215 | 0.001 |
| O107 | -------- | ----- | ------ |
| O107 | 34626 | 2345 | 0 |

522

FIG. 4J

560

| Subbasin Name | Area ( $mi^2$ ) | LossRate | Percent Impervious Area % | Initial Loss (inch) | Moisture Deficit | Wetting Front Suction (inch) | Hydraulic Conductivity (in/hr) | Transform | Time of Concentration (hour) | Storage Coefficient (hour) | Base Flow |
|---|---|---|---|---|---|---|---|---|---|---|---|
| G10333A | 5.71 | Green and Ampt | 12.7 | 0.1 | 0.436 | 3.5 | 0.024 | Clark | 1.23 | 7.21 | None |
| G10333B | 2.29 | Green and Ampt | 19.4 | 0.1 | 0.436 | 3.5 | 0.024 | Clark | 1.30 | 3.38 | None |
| G10333C | 1.31 | Green and Ampt | 34.5 | 0.1 | 0.436 | 3.5 | 0.024 | Clark | 0.46 | 6.33 | None |
| G10333D | 0.43 | Green and Ampt | 35.3 | 0.1 | 0.436 | 3.5 | 0.024 | Clark | 0.34 | 4.77 | None |
| G10333E | 1.32 | Green and Ampt | 49.1 | 0.1 | 0.436 | 3.5 | 0.024 | Clark | 0.29 | 1.27 | None |
| G10333F | 0.40 | Green and Ampt | 44.3 | 0.1 | 0.436 | 3.5 | 0.024 | Clark | 0.27 | 1.38 | None |
| G10333G | 0.26 | Green and Ampt | 37.4 | 0.1 | 0.436 | 3.5 | 0.024 | Clark | 0.19 | 1.84 | None |
| G10333H | 1.13 | Green and Ampt | 39.7 | 0.1 | 0.436 | 3.5 | 0.024 | Clark | 0.15 | 1.31 | None |
| G10333I | 0.25 | Green and Ampt | 13.5 | 0.1 | 0.436 | 3.5 | 0.024 | Clark | 0.22 | 3.61 | None |
| G10333J | 1.55 | Green and Ampt | 22.2 | 0.1 | 0.436 | 3.5 | 0.024 | Clark | 0.46 | 4.03 | None |
| G10333K | 1.68 | Green and Ampt | 36.8 | 0.1 | 0.436 | 3.5 | 0.024 | Clark | 1.07 | 2.82 | None |

561

| Reach Name | Description | Route Method | Number of Reaches | Initial Outflow Equals Inflow |
|---|---|---|---|---|
| rt_G10333#2-G10333#3 | | Modified Puls | 26.00 | Yes |
| rt_G10333#3-G10333#4 | | Modified Puls | 20.00 | Yes |
| rt_G10333#4-G10333#5 | | Modified Puls | 7.00 | Yes |
| rt_G10333#5-G10333#6 | | Modified Puls | 6 | Yes |
| rt_G10333#6-G10333#7 | | Modified Puls | 4 | Yes |
| rt_Div#2-G10333#8 | | Modified Puls | 12 | Yes |
| rt_G10333#8-G10333#9 | | Modified Puls | 6 | Yes |

FIG. 5B-1

563

| REACH ROUTING | | RESERVOIR ROUTING | | | DIVERSION | |
|---|---|---|---|---|---|---|
| SV ( ac-ft ) | SQ ( cfs ) | SE ( feet ) | SV ( ac-ft ) | SQ ( cfs ) | DI (cfs) | DQ (cfs) |
| rt_g10333#6-g10333#7 | | reservoir1 | | | div1 | |
| 0 | 0 | 1 | 2 | 3 | 0 | 0 |
| 16.18 | 265.35 | 4 | 5 | 6 | 4000 | 1000 |
| 25.04 | 541.03 | 7 | 8 | 9 | 6000 | 3000 |
| 38.17 | 1163 | 11 | 12 | 13 | 8000 | 4000 |
| 60.68 | 2483.2 | 14 | 15 | 16 | | |
| 87.89 | 3949.08 | 17 | 18 | 19.5 | | |
| 113.99 | 5340.7 | | | | | |
| 142.97 | 6855.15 | | | | | |
| | | | | | | |
| | | | | | | |
| rt_g10333#5-g10333#6 | | | | | | |
| 0 | 0 | | | | | |
| 20.94 | 216.35 | | | | | |
| 32.26 | 444.03 | | | | | |
| 49.61 | 968 | | | | | |
| 77.19 | 2094.2 | | | | | |
| 168.95 | 5883.15 | | | | | |
| 215.66 | 7116.76 | | | | | |
| 544.89 | 12133.31 | | | | | |

562

| Reservoir Name | Description | Route Method | Routing Curve | Initial Outflow Equals Inflow ? |
|---|---|---|---|---|
| reservoir1 | | Modified Puls | Storage-Elevation-Outflow | Yes |

FIG. 5B-2

610

| HMS-RUNs | HMS Node Locations |
|---|---|
| 0.2%Rain | g10333#1 |
| 1%Rain | g10333#2 |
| | div#2 |
| | g10333#3 |
| | g10333#4u |
| | g10333#4 |
| | g10333#5 |
| | g10333#6u |
| | g10333#6 |
| | g10333#7 |
| | g10333#8 |
| | g10333#9 |

611

| Node Name | Area (mi^2) | 0.2%Rain (Flow) | 1%Rain (Flow) |
|---|---|---|---|
| g10333#1 | 5.71 | 3215 | 2710 |
| g10333#2 | 8 | 6155 | 4825 |
| div#2 | 8 | 4727 | 3639 |
| g10333#3 | 9.31 | 5630 | 4237 |
| g10333#4u | 9.74 | 5919 | 4411 |
| g10333#4 | 11.06 | 6414 | 4719 |
| g10333#5 | 11.46 | 6427 | 4773 |
| g10333#6u | 11.72 | 6497 | 4828 |
| g10333#6 | 12.85 | 7512 | 5631 |
| g10333#7 | 13.1 | 7795 | 5828 |
| g10333#8 | 1.55 | 3172 | 2393 |
| g10333#9 | 3.23 | 5460 | 4016 |

Fig. 6B

640

| QT Stations Beyond the Upper Most Node | Drainage Area To This Point |
|---|---|
| 59497.7 | 0.077 |
| 55886.66 | 0.492 |
| 52886.39 | 1.064 |
| 51370.22 | 1.245 |

| Node Name | Draiage Area at Hydrology Nodes | Storm1 (cfs) | Storm2 (cfs) |
|---|---|---|---|
| O100#1 | 2.882 | 2950 | 1969 |
| O100#2 | 6.645 | 4378 | 3254 |
| | 9.279 | 5537 | 3978 |
| | 11.652 | 6396 | 4688 |
| | 13.212 | 7258 | 5579 |
| | 13.801 | 7173 | 5599 |
| | 15.148 | 7533 | 6146 |
| | 17.081 | 9317 | 7349 |
| | 21.613 | 14381 | 10707 |
| O100#8 | 27.034 | 16082 | 11855 |

641

| Station Number | Drainage Area (From Column B) | Storm 1 (cfs) | Storm 2 (cfs) | Storm 1 Difference (%) | Storm 2 Difference (%) |
|---|---|---|---|---|---|
| 59497.7 | 0.077 | 153.5 | 86.0 | | |
| 55886.66 | 0.492 | 633.1 | 394.7 | 312.5 | 358.9 |
| 52886.39 | 1.064 | 1141.4 | 743.7 | 80.3 | 88.5 |
| 51370.22 | 1.245 | 1287.0 | 846.2 | 12.8 | 13.8 |

FIG. 6E

670

| QT Stations | Hydrology Nodes | Hydraulic Stations | Storm1 (cfs) | Storm2 (cfs) |
|---|---|---|---|---|
| 29329.48 | g10333#2 | 29329.481 | 6155 | 4825 |
| 27445 | div#2 | 29329.48 | 4727 | 3639 |
| 27441.69 | g10333#3 | 21221.31 | 5630 | 4237 |
| 25326 | g10333#4u | 13295.8 | 5919 | 4411 |
| 25324.46 | g10333#4 | 13295.8 | 6414 | 4719 |
| 23234.05 | g10333#5 | 9501.098 | 6427 | 4773 |
| 21221.31 | g10333#6u | 6455.4924 | 6497 | 4828 |
| 13300 | g10333#6 | 6455.4924 | 7512 | 5631 |
| 13295.8 | g10333#7 | 3175.311 | 7795 | 5828 |
| 9501.098 | | | | |
| 6455.4924 | | | | |
| 3200 | | | | |
| 3175.311 | | | | |

| Station # | Storm 1 (cfs) | Storm 2 (cfs) | Storm 1 Difference (%) | Storm 2 Difference (%) |
|---|---|---|---|---|
| 29329.48 | 4727.0 | 3638.7 | | |
| 27441.69 | 4923.3 | 3769.9 | 4.2 | 3.6 |
| 25324.46 | 5153.2 | 3922.8 | 4.7 | 4.1 |
| 23234.05 | 5390.8 | 4079.8 | 4.6 | 4.0 |
| 21221.31 | 5629.8 | 4237.0 | 4.4 | 3.9 |
| 13295.8 | 5918.7 | 4410.5 | 5.1 | 4.1 |
| 13295.8 | 6414.3 | 4719.0 | N/A | N/A |
| 9501.098 | 6427.1 | 4772.8 | 0.2 | 1.1 |
| 6455.4924 | 6497.1 | 4827.8 | 1.1 | 1.2 |
| 6455.4924 | 7512.2 | 5631.4 | N/A | N/A |
| 3175.311 | 7795.2 | 5827.6 | 3.8 | 3.5 |

671

FIG. 6H

METHOD AND SYSTEM TO FLEXIBLY CALCULATE HYDRAULICS AND HYDROLOGY OF WATERSHEDS AUTOMATICALLY

CROSS REFERENCE TO RELATED APPLICATIONS (Not Applicable)

OTHER REFERENCES

Ven Te Chow, "Open Channel Hydraulics", 1959, McGraw-Hill Book Company, p586–621.

Ven Te Chow et al., "Applied Hydrology", 1988, McGraw-Hill, Inc., p127–166.

FIELD OF THE INVENTION

This invention relates to the combination of computerization and calculation of hydraulics and hydrology of watersheds. More particularly, this invention relates an optimized way using standalone computer modules to control the calculation of hydraulics and hydrology automatically with flexibility considering the complexity and judgment of engineering practice.

BACKGROUND OF THE INVENTION

For hydraulics and hydrology practice, mostly engineers use DOS programs such as HEC-2 and HEC-1 etc. to calculate the water surface elevation and peak flow rates from 1980s. During recent years, people start to use Windows programs such as HEC-RAS and HEC-HMS to finish the same task user-friendly and graphically. At the same time, engineers have utilized the GIS program to get the survey data graphically and geo-referenced to make planning and study much easier and straightforward. Since GIS data mostly comes from satellite or plane survey, the information provided is very detailed and with huge amount which is almost impossible to be processed by the traditional methods. For example, the total number of cross sections for a river study could be tripled using the new GIS method compared to the old one. The total points of one cross section using the GIS data could be ten times of that of the same cross section using human survey. This makes many existing methods become very time consuming, tedious and error prone because of the manual or half-manual process.

Traditionally a lot of hydraulics and hydrology calculations of watersheds were done through engineering papers to get or calculate parameters and then type them as input for other programs or spreadsheets to get the result. A lot of time is wasted in charts searching, typing data and setting up a spreadsheet, there is no automatic error checking either. Most importantly, the experience of previous projects cannot be passed to the new ones easily. With the increasing use of GIS data, this huge amount of data sometimes makes finding data or even copying or pasting data a formidable task. In this new system of calculation, the computer programs can automatically find data from the database built from engineering charts, retrieve required results from the HEC-RAS, GIS or HEC-HMS etc., perform calculation for spreadsheets without typing formula, check input-data errors, and put the output in a popularly used format. It will save huge amount of time just for one round of calculation, and usually engineers need to change input parameters many times for each step of a project, the time needed for other rounds of calculations is just clicks away.

Previously some spreadsheets were setup to calculate parts of the parameters of a watershed. Compared to manual calculations, the spreadsheets are quick and flexible, but there are several drawbacks. The first disadvantage is that engineers need to be very careful with the formula and relationship between the spreadsheet cells. Some insertion, deletion or accidents can cause unnoticed mistakes, especially when used by other people who did not design the spreadsheets. The second disadvantage is that a single modification in the future will not be updated in the old releases of the spreadsheets, and is hard to maintain because of many versions. The third disadvantage is that it cannot pre-check the input data following the engineering concepts or computation rules.

Nowadays many applications and spreadsheets are used for some calculations already but are not optimized to form a seamless stream of calculation. The results of one application need special treatments to be used by other ones. One of the major reasons for this situation is the lack of the integration of enough computer knowledge with the thorough understanding of practical hydraulics and hydrology. Another reason is that some manual or half-manual routines are hard to be generalized and optimized mathematically through computerization because of its variety and specialty. So the final new tasks for this invention are to find an optimized computation process based on a thorough engineering knowledge and create new computation methods for the non-computerized work in the process.

In the current engineering practice, one project is usually reviewed by several government agencies that have different engineering guidance and manuals. For one single calculation, there may be several kinds of settings just because of different specified parameters, and some agencies may require using different kinds of application programs to do the same task. These application programs may be upgraded in the future too. Based on all of these diversity and dynamics of changing, flexibility is very important for any method to calculate hydraulics and hydrology of watersheds.

Based on above understanding, we can see that the need to optimize the calculation processes by computer programs automatically and flexibly is imperative. These needs are widespread in many aspects such as reducing the time on inputting data, changing data format between different applications, and creating new applications for atomization and utilizing existing spreadsheets and applications.

A few options were considered. One of them is to create one single computer program, which can handle all the calculations from survey data to the final result like mapping the flood boundaries. This option is dropped since engineers will be confused in the beginning if they need to do a lot of initial setups without knowing the engineering logic. Another reason is that much information is just partial in the beginning and will be gradually completed during the progress of a project. Considering that engineers have utilized a lot of spreadsheets already to do calculations and to present reports for its flexibility and powerful functions, we come up with a flexibly automated method and system to finish the complex projects by integrating engineering concepts, logic, and other applications such as EXCEL, GIS, HEC-RAS, HEC-HMS etc. .

Therefore, there is a need in the art for an efficient method and system to calculate the hydraulics and hydrology of watersheds with a variety of parameters so that the time-consuming, labor-intensive tasks can be greatly reduced. There is also a need in the art for a method and system to calculate hydraulics and hydrology of watersheds with standalone programs controlling and communicating with other computer applications such as EXCEL, HEC-RAS, HEC-HMS, and GIS. There is a further need in the art for a method and system to calculate hydraulics and hydrology of watersheds with intact engineering logic and with a great flexibility to a variety of practical situations by integrating with other existing applications to form a seamless stream of calculation.

BRIEF SUMMARY OF THE INVENTION

The present invention satisfies the above-described needs by providing a method and system to calculate the hydraulics and hydrology of watersheds with a variety of parameters efficiently and flexibly. The present invention allows the use of popular spreadsheets controlled by computer codes planted inside standalone program modules. The present invention links the existing application programs and data sources seamlessly to form a stream of calculation of hydraulics and hydrology with error checking and user-friendly interface. The present invention makes engineers with basic hydrology and hydraulics knowledge be familiar with the modules easily and finish a big project quickly because the optimized process follows the engineering logic closely and packages some tedious routines in black boxes.

Generally described, when a user wants to finish the hydraulics and hydrology calculation of a watershed from the beginning to the end, five computer modules accompanied with the present invention will be used, and they are GIS Pre-processor, HEC-HMS Pre-processor, HMS Input Converter, HEC-RAS Pre-processor, and GIS Post-processor. Each of the modules is formed by several functions, and the input data and output data are linked among the functions and modules through the modules communicating with spreadsheets, databases or text files. The input of these functions can also come from other existing applications as long as the designed format is met.

More particularly described, one aspect of the present invention is to provide an easy way to utilize the existing spreadsheets such as EXCEL and other applications like GIS, HEC-RAS, and HEC-HMS. When the user clicks a function, a user form pops up and at the same time the function bring up or connect to other applications such as EXCEL, HEC-RAS, and HEC-HMS. Then the user needs to type in or link the input data on the spreadsheets, on the user form, or open a new project from other applications like HEC-RAS and HEC-HMS. Finally after clicking the OK button, the function starts the process of checking the input data, performing the calculation, and placing the results on spreadsheets, text files or databases. During this process, the function communicates with other applications to finish the task without any other efforts from the user.

In another aspect of the present invention, the use of this invention is very flexible, uniform and stable. Since other applications such as HEC-RAS, HEC-HMS and GIS used by engineers nowadays will be upgraded frequently by other software companies, the modules of this invention are not integrated to any of them. A module only functions as a control center to communicate with other existing applications through their interfaces. The modules created in this invention are stable because these interfaces usually are retroactive or are not upgraded. The result generated by a module is also uniform, which makes it easy to be linked or used by other applications. To satisfy the situation that different government agencies have many kinds of guidance and manual for engineering calculations, this invention is flexible in user input such as parameter selection and method picking. Also most of the results of this invention are placed in spreadsheet format that is the most popular way to present tables in a report, and user can format their own tables by linking the data generated by the functions of this invention.

In another aspect of the present invention, the use of this invention is automation and intelligence. The functions of this invention can validate the input data sources by engineering concepts and computation rules. This can greatly reduce the common errors in calculation from the beginning, and quality of a project can be increased significantly with a little effort. This invention reduced many time-consuming, labor-intensive tasks that have never been automated so easily before. A lot of common routines are greatly generalized mathematically and logically so that the computerization is possible. The logic is based on the extensive practical experience in the field of hydraulics and hydrology so that it can be understood easily and be used friendly.

These and other features, advantages, and aspects of the present invention will be more clearly understood and appreciated from a review of the following detailed description of the disclosed embodiments and by reference to the appended drawing and claims.

BRIEF DESCRIPTION OF THE DRAWINGS

FIG. 4C illustrates an example of the input and output spreadsheets for the slope, conveyance and storage-outflow calculation;

FIG. 4G illustrates an example of the input and output spreadsheets for the cumulative drainage area, development percentage and conveyance flow calculation;

FIG. 4J illustrates an example of the input spreadsheet may be used in the function of Importing Gage Data;

FIG. 5B illustrates an example of the input data spreadsheet may be used in the module of HMS Input Converter;

FIG. 6B illustrates an example of the input data spreadsheet that may be used in the function of Retrieving Drainage Area and Peak Flow Rates;

FIG. 6E illustrates an example of the input data spreadsheet may be used in the function of Extrapolating Peak Flows;

FIG. 6H illustrates an example of the input data spreadsheet that may be used in the function of Interpolating Peak Flows;

DETAILED DESCRIPTION OF THE INVENTION

Figure 1:
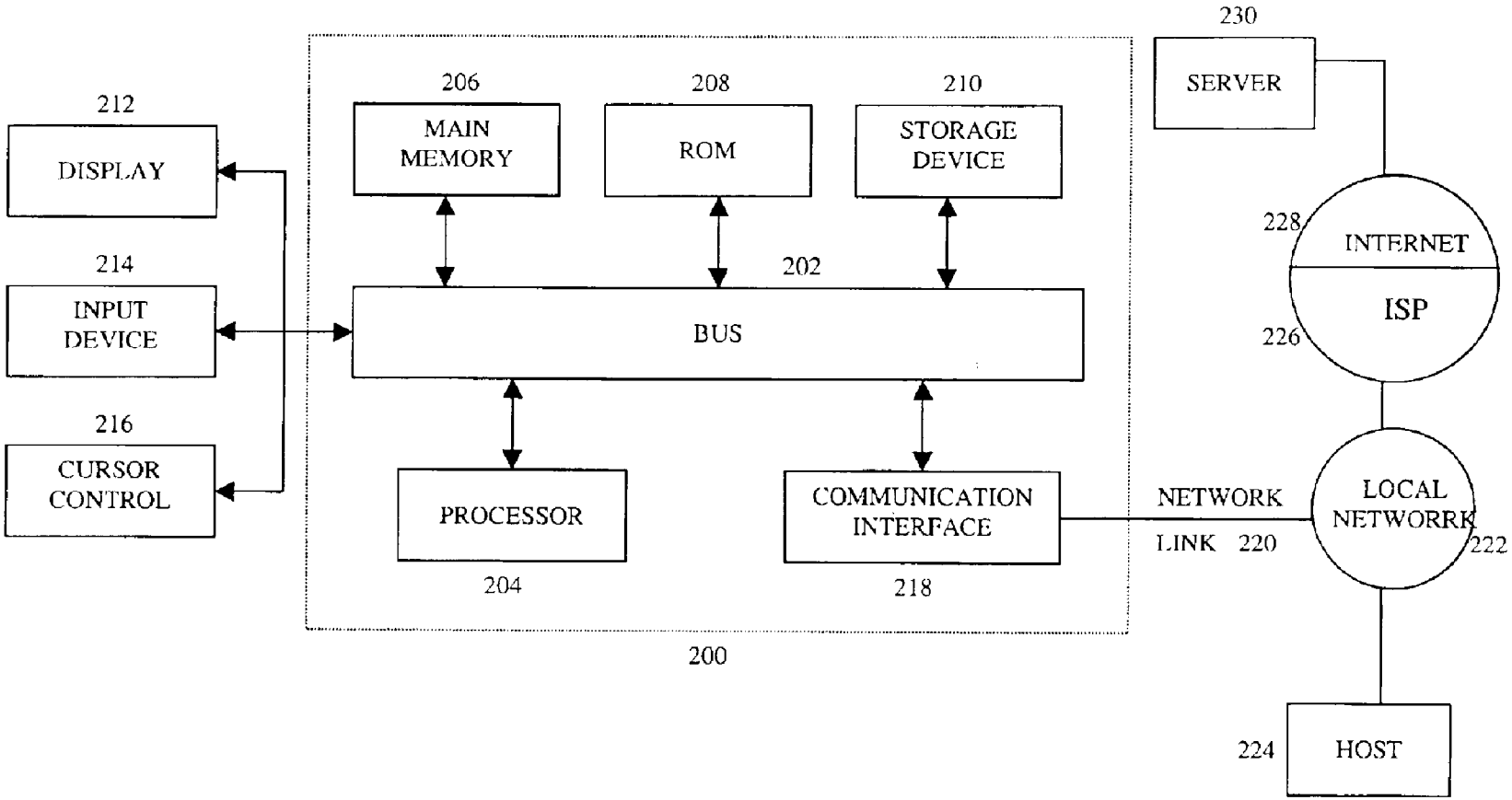
FIG. 1 is a block diagram of a computer system providing operating environment for an exemplary embodiment of the present invention.

A method and system to flexibly calculate the hydraulics and hydrology of watersheds automatically is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid obscuring the present invention unnecessarily.

The method and system of the present invention consists of several independent automatic steps, but one step's result can be linked as the input of other steps through spreadsheets or text files to form a seamless stream of calculation. The advantage of this system is automation with flexibility. The user can use all the modules for a big project or just a part of the calculation stream for a small project or for the modification of a big project. It has greatly reduced the amount of paper used, time spent on searching engineering charts, time used on typing or even copying and pasting compared to the traditional way of hydraulics and hydrology calculation for a watershed. All the calculations are finished by standalone computer programs that are not embedded in spreadsheets and are not wholly integrated with other applications. This makes it easier to maintain the programs and prevent errors. The standalone computer modules communicate with other application programs such as EXCEL, HEC-RAS, GIS or HEC-HMS etc. to retrieve input parameters and put the results back to spreadsheets or text files automatically.

For the purposes of this discussion, a process is generally conceived to be a sequence of computer-executed steps leading to a desired result. These steps generally require physical manipulations of physical quantities. Usually, though not necessarily, these quantities take the form of electrical, magnetic, or optical signals capable of being stored, transferred, combined, compared, or otherwise manipulated. It is conventional for those skilled in the art to refer to these signals as bits, bytes, words, values, elements, symbols, characters, terms, numbers, points, records, objects, images, files or the like. It should be kept in mind, however, that these and similar terms should be associated with appropriate physical quantities for computer operations, and that these terms are merely conventional labels applied to physical quantities that exist within and during operation of the computer.

It should also be understood that manipulations within the computer are often referred to in terms such as adding, calling, comparing, receiving, sending, reading, transferring, determining, routing, selecting, transmitting, etc. which are often associated with manual operations performed by a human operator. The operations described herein are machine operations performed in conjunction with various input provided by a human operator or user that interacts with the computer.

Generally, program modules include routines, programs, components, and data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, microcomputers, mainframe computers, and the like. The invention can also be practiced in distributed computing environment where tasks are performed by remote processing devices that are linked through a communications network. In a distributed computing environment, program modules may be located in both local and remote memory storage devices.

Referring now to the drawings, the numerals representing elements throughout all the figures, aspects of the present invention and the preferred operating environment will be described.

Exemplary Operating Environment

The detailed description that follows is represented largely in terms of processes and symbolic representations of operations by conventional computer components, including a processor, memory storage devices for the processor, connected display devices, and input devices. Furthermore, these processes and operations may utilize conventional computer components in a heterogeneous distributed computing environment, including remote file servers, computer servers, and memory storage devices. Each of these conventional distributed computing components is accessible by the processor via a communication network.

The processes and operations performed by the computer include the manipulation of signals by a processor or remote server and the maintenance of these signals within data structures resident in one or more of the local or remote memory storage devices. Such data structures impose a physical organization upon the collection of data stored within a memory storage device and represent specific electrical or magnetic elements. These symbolic representations are the means used by those skilled in the art of computer programming and computer construction to most effectively convey teachings and discoveries to others skilled in the art.

FIG. 1 and the following discussion are intended to provide a brief, general description of a suitable computing environment in which the present invention maybe implemented. While the invention will be presented in the general context of program modules that will be running on an operating system in a personal computer, those skilled in the art will recognize that the invention can also be implemented with other computer modules.

FIG. 1 is a block diagram that illustrates a preferred computer system 200 upon which an embodiment of the invention may be implemented. Computer system 200 includes a bus 202 or other communication mechanism for communicating information, and a processor 204 coupled with bus 202 for processing information. Computer system 200 also includes a main memory 206, such as a random access memory (RAM) or other dynamic storage device, coupled to bus 202 for storing information and instructions to be executed by processor 204. Main memory 206 also may be used for storing temporary variables or other intermediate information during execution of instructions to be executed by processor 204. Computer system 200 further includes a read only memory (ROM) 208 or other static storage device coupled to bus 202 for storing static information and instructions for processor 204. A storage device 210, such as a magnetic disk or optical disk, is provided and coupled to bus 202 for storing information and instructions.

Computer system 200 may be coupled via bus 202 to a display 212 for displaying information to a computer user. An input device 214, including alphanumeric and other keys, is coupled to bus 202 for communicating information and command selections to processor 204. Another type of user input device is cursor control 216, such as a mouse, a trackball, or cursor direction keys for communicating direction information and command selections to processor 204 and for controlling cursor movement on display 212.

The invention is related to the use of computer system 200 for the calculation of hydraulics and hydrology of watersheds. According to one embodiment of the invention, doing the calculation is provided by computer system 200 in response to processor 204 executing one or more sequences of one or more instructions contained in main memory 206. Such instructions may be read into main memory 206 from another computer-readable medium, such as storage device 210. Execution of the sequences of instructions contained in main memory 206 causes processor 204 to perform the process steps described herein. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 204 for execution. Such a medium may take many forms, including but not limited to, non-volatile media, volatile media, and transmission media. Non-volatile media includes, for example, optical or magnetic disks, such as storage device 210. Volatile media includes dynamic memory, such as main memory 206. Transmission media includes coaxial cables, copper wire and fiber optics, including the wires that comprise bus 202. Transmission media can also take the form of acoustic or light waves, such as those generated during radio wave and infrared data communications.

Common forms of computer-readable media include, for example, a floppy disk, a flexible disk, hard disk, magnetic tape, or any other magnetic medium, a CD-ROM, any other optical medium, punch cards, paper tape, any other-physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor 204 for execution. For example, the instructions may initially be carried on a magnetic disk of a remote computer. The remote computer can load the instructions into its dynamic memory and send the instructions over a telephone line using a modem. A modem local to computer system 200 can receive the data on the telephone line and use an infrared transmitter to convert the data to an infrared signal. An infrared detector can receive the data carried in the infrared signal and appropriate circuitry can place the data on bus 202. Bus 202 carries the data to main memory 206, from which processor 204 retrieves and executes the instructions. The instructions received by main memory 206 may optionally be stored on storage device 210 either before or after execution by processor 204.

Computer system 200 also includes a communication interface 218 coupled to bus 202. Communication interface 218 provides a two-way data communication coupling to a network link 220 that is connected to a local network 222. For example, communication interface 218 may be an integrated services digital network (ISDN) card or a modem to provide a data communication connection to a corresponding type of telephone line. As another example, communication interface 218 may be a local area network (LAN) card to provide a data communication connection to a compatible LAN. Wireless links may also be implemented. In any such implementation, communication interface 218 sends and receives electrical, electromagnetic or optical signals that carry digital data streams representing various types of information.

Network link 220 typically provides data communication through one or more networks to other data devices. For example, network link 220 may provide a connection through local network 222 to a host computer 224 or to data equipment operated by an Internet Service Provider (ISP) 226. ISP 226 in turn provides data communication services through the worldwide packet data communication network now commonly referred to as the "Internet" 228. Local network 222 and Internet 228 both use electrical, electromagnetic or optical signals that carry digital data streams. The signals through the various networks and the signals on network link 220 and through communication interface 218, which carry the digital data to and from computer system 200, are exemplary forms of carrier waves transporting the information.

Computer system 200 can send messages and receive data, including program code, through the network(s), network link 220 and communication interface 218. In the Internet example, a server 230 might transmit a requested code for an application program through Internet 228, ISP 226, local network 222 and communication interface 218. In accordance with the invention, one such downloaded application provides for the hydraulics and hydrology calculation of watersheds as described herein.

The received code may be executed by processor 204 as it is received, and/or stored in storage device 210, or other non-volatile storage for later execution. In this manner, computer system 200 may obtain application code in the form of a carrier wave.

Having described an exemplary operating environment for the present invention, it will prove helpful to generally discuss hydraulics and hydrology calculation of watersheds.

Hydraulics and Hydrology Calculation of Watersheds

The hydraulic and hydrology calculation of watersheds are well known to those skilled in the art, but a general discussion of those processes will prove helpful for the subsequent description of an exemplary embodiment of the present invention.

Hydraulics and hydrology calculation of watersheds are two coupled processes. When calculating hydrology parameters, the hydraulic model is needed to get some parameters related to the conveying channels in the sub-basins such as channel slope, storage-outflow relationship and percentage of flow in the main channel. When doing hydraulic calculations, one of the necessary components is the flow rate that needs to be finished by hydrology calculation. Because of this interaction, some steps such as the storage-outflow relationship have to be converged by trial and error. Every iteration needs to update great amount of information, and unfortunately some of them have to be typed or copied item by item.

The popularly used Windows program for hydraulic calculation is HEC-RAS and the one for hydrology calculation is HEC-HMS. One major function of HEC-RAS program is calculating water surface elevation, storage volume, and travel velocity. One major function of HEC-HMS program is calculating peak flow rates, rainfall loss, and rainfall excess volume. Both of these two programs utilize the DSS database to store input and output data, and DSS database is a special kind of database mainly used by hydraulics and hydrology calculation. For example, all the time series data such as rainfall data and all the paired data such as storage-outflow are stored in the DSS database.

Both hydraulics and hydrology modeling need a lot of survey data. Nowadays the survey data can be obtained from satellite and plane and usually in GIS DEM format. Human survey still cannot be totally replaced since the ground are covered by some obstacles such as trees, water and structures. Therefore the survey data by human being needs to be overlaid on top of the survey data by machine to get an accurate picture of the ground information.

The final product of hydraulic and hydrology calculation are computer models and maps. The models can be used by other projects in the future. One of the major maps is the flood plain and flood way boundary map that is used to determine the flood insurance rates and to manage the emergency. Formerly these maps are made half manually and are not geo-referenced, now it is getting popular to generate the maps in geo-referenced GIS shape files.

Figure 2:
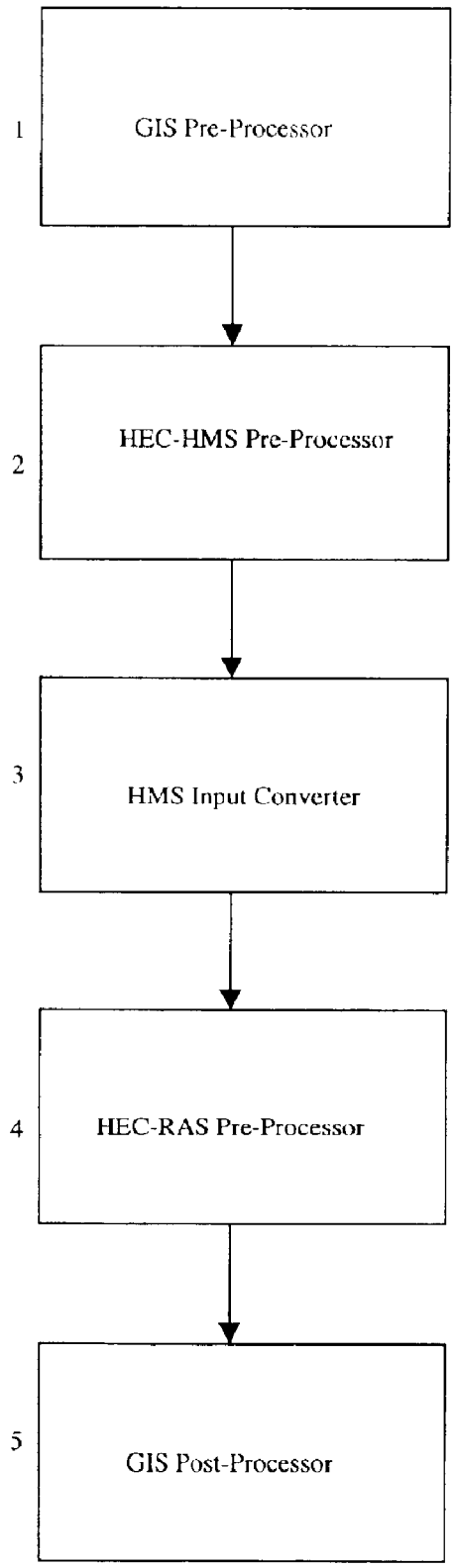
FIG. 2 is a functional block diagram of an optimized calculation stream for an exemplary embodiment of the present invention.

In an exemplary embodiment, the present invention provides and optimized system to calculate the hydraulics and hydrology of watersheds automatically and flexibly from survey data to the final product. The system of the present invention is formed by five independent modules. These modules can be integrated by users with other programs such as HEC-RAS, HEC-HMS and GIS to form a seamless stream of calculation. They can be combined in different order, combined partially, and the user can even use just one single module or function. One preferred embodiment of the present invention is to form the seamless calculation stream in the following order as shown in FIG. 2, and the components are: GIS Pre-Processor 1, HEC-HMS Pre-Processor 2, HMS Input Converter 3, HEC-RAS Pre-Processor 4, and GIS Post-Processor 5.

There are several functions under each program module. GIS Pre-Processor 1 has two functions: Import Survey Text Files and Align Survey Points to the Best-fit Line; HEC-HMS Pre-Processor 2 contains five functions: Calculate Slope & Conveyance Percentage, Calculate Cumulative Area and Development Percentage, Calculate Conveyance Flow Rates, Calculate Storage-Outflow Relationship, and Import Gage Data; HMS Input Converter 3 is formed by three functions: Convert Spreadsheet Data to HEC-HMS, Align HEC-HMS Components to GIS Coordinates, and Clean HEC-HMS Project; HEC-RAS Pre-Processor 4 consists of three functions: Retrieve Drainage Area and Peak Flow Rates, Extrapolate Peak Flow, and Interpolate Peak Flow; and GIS Post-Processor 5 has one function Map Flood Plain and Flood Way Boundaries. We will give further detailed explanation in the following paragraphs for each module and its functions.

GIS Pre-Processor

As described previously, GIS Pre-Processor reads in survey data automatically to create new point shape files and polyline shape files in GIS. The survey points from surveyor are presented in comma separated or space separated test files, and they usually have five columns: Point No., X Coordinate, Y Coordinate, Z Coordinate, and Description. These coordinates are geo-referenced to a certain horizontal datum and vertical datum. The purpose of using these survey points is to get the accurate cross section profile for the main channel that is covered by water and the DEM data from satellite or plane cannot be used. Most of times, the survey points for one cross section are not on a straight line and some invalid points such as structures are not separated. Therefore we need to import all the points into a GIS shape file and select the points for one cross section according to point descriptions or satellite image to create a cross section polyline passing through the best fit line automatically.

Figure 3A:
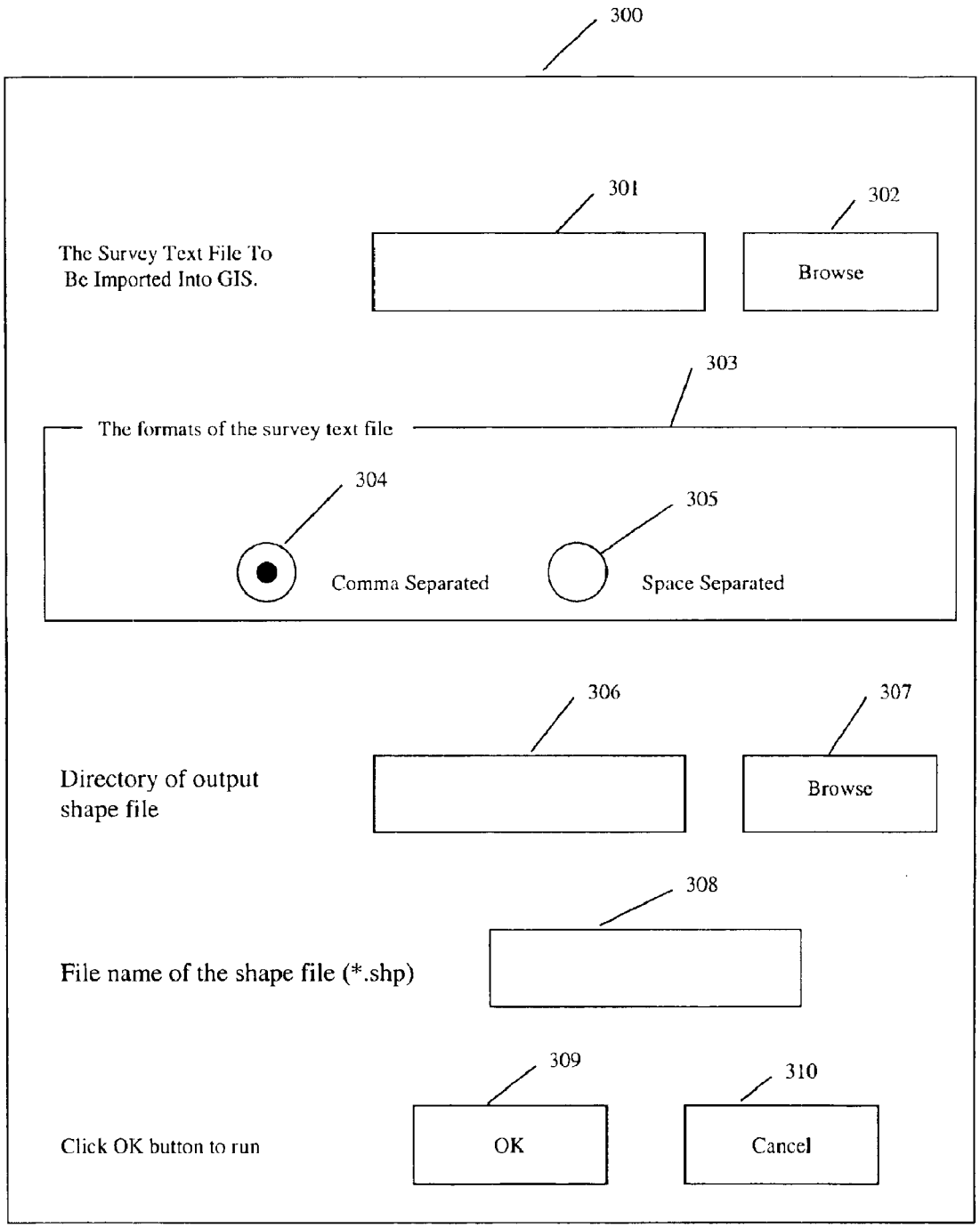
FIG. 3A illustrates an example of the user interface control setting that may be used in the function of Importing Survey Text Files.

With reference to FIG. 3A, which is the illustration of the data input form 300 that pops up after a user clicking the function Import Survey Text Files. A user can click the Browse button 302 to select the existing survey text file and the selected file path and name will be shown in the textbox 301. In order to specify the type of the test file, there is a frame 303 containing two option items 304 and 305 on the form. Only one case can be selected, which means the text file is either comma separated or space separated. The bottom part of the form is the file path and name for the output point shape file. After clicking the Browse button 307, the output file path will be listed in the textbox 306. A user can type in the file name in the textbox 308 with the extension *.shp. The final step is to click the OK button 309 to generate the point shape file automatically, or click the Cancel button 310 to exit the function.

More particularly about the best-fit line generation, the user can first use the query function in GIS program or manually select all the points for one cross section, then click the function Align Survey Points to the Best-fit Line.

The function uses linear regression to get the slope and interception value in the (x, y) plane for the best-fit line, projects all the points to the best fit line but keep z values unchanged, and finally creates a polyline using the projected points as vertexes.

Figure 3B:
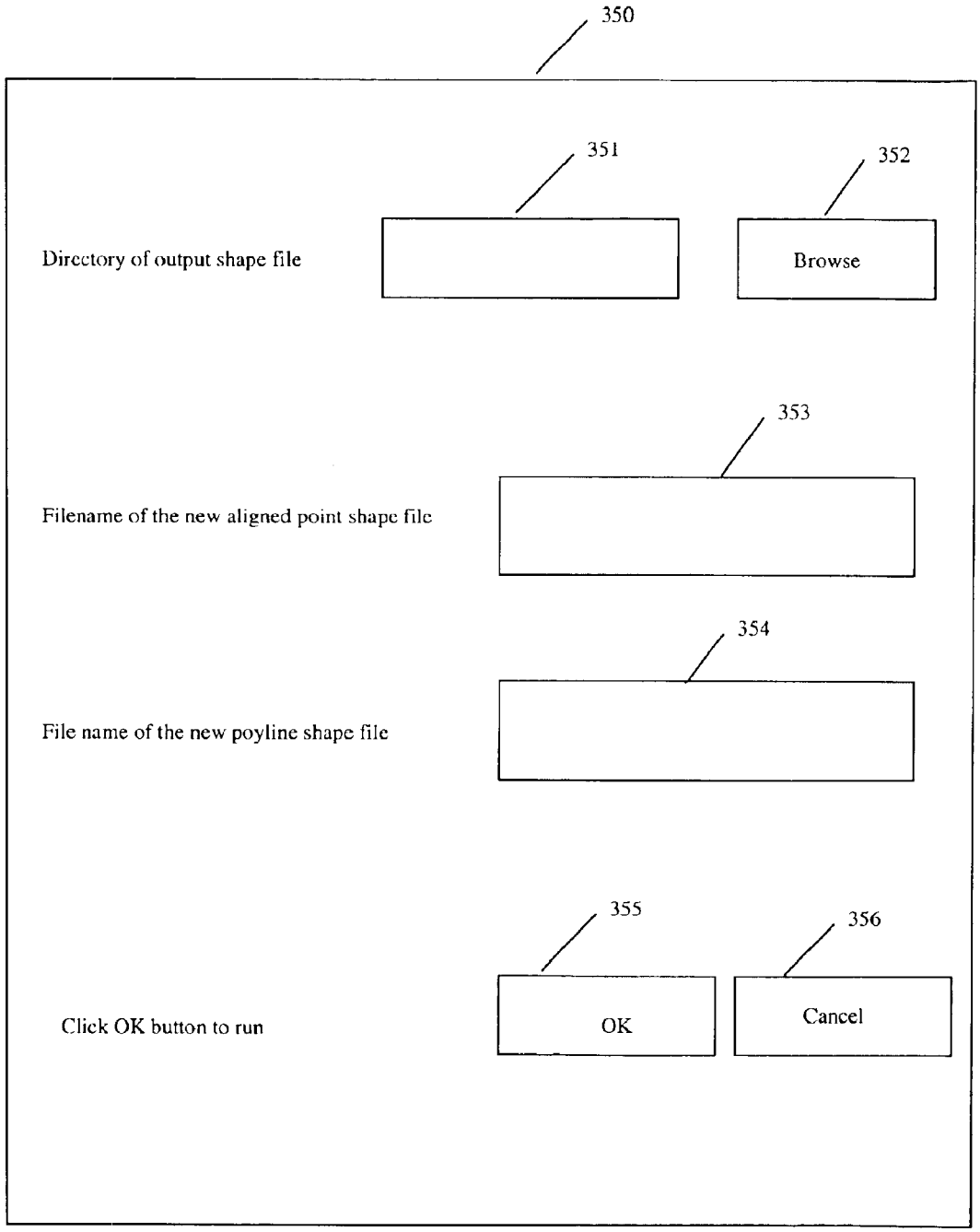
FIG. 3B illustrates an example of the user interface control setting that may be used in the function of Aligning Survey Points to the Best-fit Line.

With reference to FIG. 3B, which is the illustration of the input form 350 that pops up after a user clicking the function Align Survey Points to the Best-fit Line. The user can click the Browse button 352 to select the output file directory, and the selected path will be listed in the textbox 351. In textbox 353, the user needs to type in the file name for the new aligned point shape file; and the filename for the new polyline shape file can be specified in the textbox 354. Finally the user needs to click the OK button 355 to run the function automatically, or to click the Cancel button 356 to exit the function.

Figure 3C:
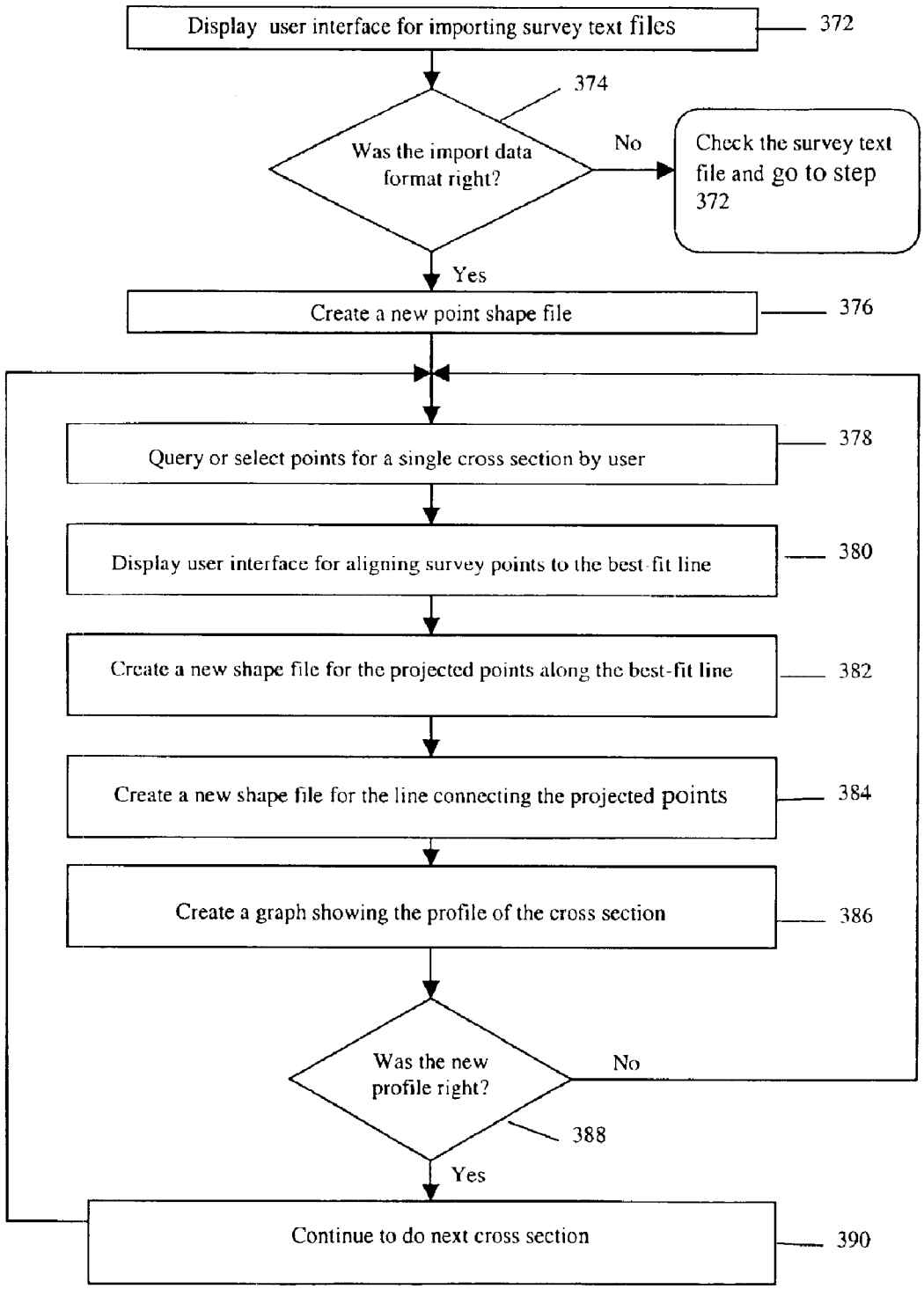
FIG. 3C illustrates a flow diagram of a process for GIS Pre-Processor.

FIG. 3C illustrates a flow diagram of a process for GIS Pre-Processor. For explanation purpose, the steps of FIG. 3C will be described in reference to the components of FIG. 3A and FIG. 3B.

At step 372, a user interface is displayed to allow the user to define the survey text file and output shape file information. For example, the user may be presented with a user interface 300 as previously described in FIG. 3A.

At step 374, a determination is made on whether the survey data has followed the right format discussed above. If the format is right, a new point shape file is created at step 376 based on the (x,y,z) value listed in the survey text file. If the format is not correct, the user needs to check the survey text file and go back to step 372.

At step 378, the user can select or query the points for one single cross section. At step 380, a user interface is displayed to allow the user to define the output shape file name. For example, the user may be presented with a user interface 350 as previously described in FIG. 3B.

At step 382, the function creates a new point shape file for the projected points along the best-fit line. The function then creates a new polyline shape file by using the position of the projected points as its vertexes at step 384. At the same time, the function generate a new 2D graph of the cross section profile using the distance in (x,y) plane and z value at step 386.

At step 388, a determination is made by the user based on the graph generated from the last step. If the profile is correct, the user proceeds to step 390 to continue working on the next cross section. If the profile is wrong, the user needs to go back to step 378 to select a new set of points.

HEC-HMS Pre-Processor

As described previously, HEC-HMS Pre-Processor calculates hydrology parameters automatically to prepare the input data for HEC-HMS program. The time of concentration and storage are two key parameters for hydrology calculation. The calculation of these two parameters needs to determine several other parameters first. Five of them are very time consuming and error prone, and they are: channel slope, percentage of channel conveyance, storage-outflow relationship, cumulative area and development percentage, and conveyance flow rates. Another labor-intensive task is importing gage data, which includes rainfall gages and stream gages. There are many gages for one watershed, each gage can have records of several selected typical storm events, and each standard storm event usually lasts for several days with 15 minutes time interval. It is a tedious job to copy and paste this huge amount of data and assign them to each gage in HEC-HMS program. This HEC-HMS Pre-Processor module finished the above tasks automatically and flexibly, and the detailed description will be given below.

The HEC-HMS Pre-Processor module controls the spreadsheet program and the HEC-RAS program, and it communicates with them when calculating channel slope, percentage of channel conveyance, and storage-outflow relationship. Before using this module, two user defined tables in HEC-RAS program need to be set up, but this step just needs to be done once since the HEC-RAS program will remember the user defined tables. One table for the calculation of channel slope and percentage of channel conveyance is named P-Conveyance-Slope, and it consists of five columns: Reach, River Sta, Min Ch El, Q Perc Chan, and Cum Ch Len from left to right. The other table for the calculation of storage-outflow relationship is called P-Storage-Outflow, it also contains five columns: Reach, River Sta, Q Total, Volume, and Trvl Time Avg from left to right.

Figure 4A:
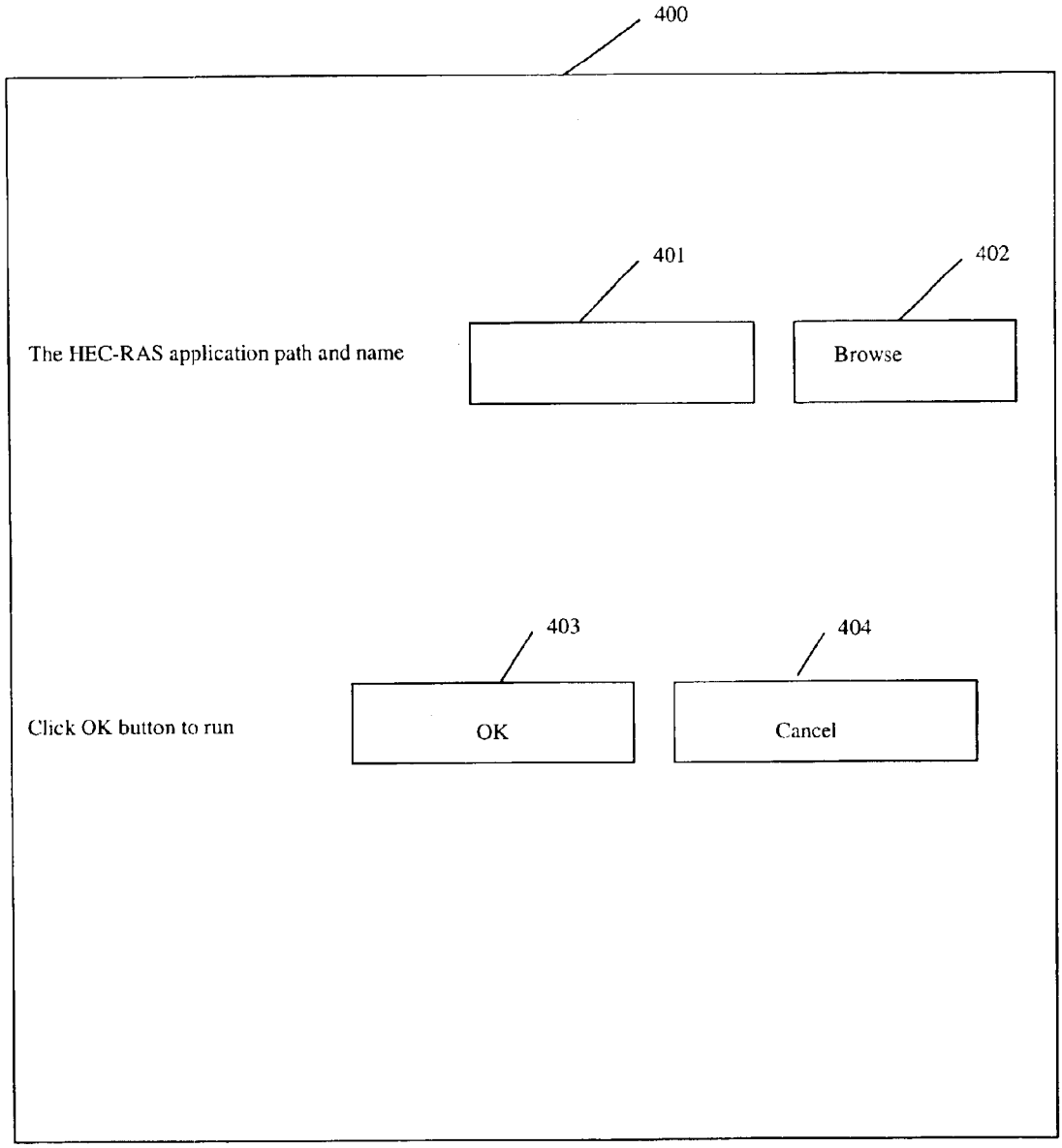
FIG. 4A illustrates an example of the user interface control setting that may be used in the function of Calculating Slope & Conveyance Percentage.

With reference to FIG. 4A, which is the illustration of the input form 400 that pops up after a user clicking the function Calculate Slope & Conveyance Percentage. The user can click the Browse button 402 to setup the directory and name of the HEC-RAS program in the textbox 401. This just needs to be done once, and the function will remember that setting. Clicking the OK button 403 will make the function proceed to do the calculation communicating with the HEC-RAS application and the spreadsheet application. After clicking the Cancel button 404, the function will exit.

Figure 4B:
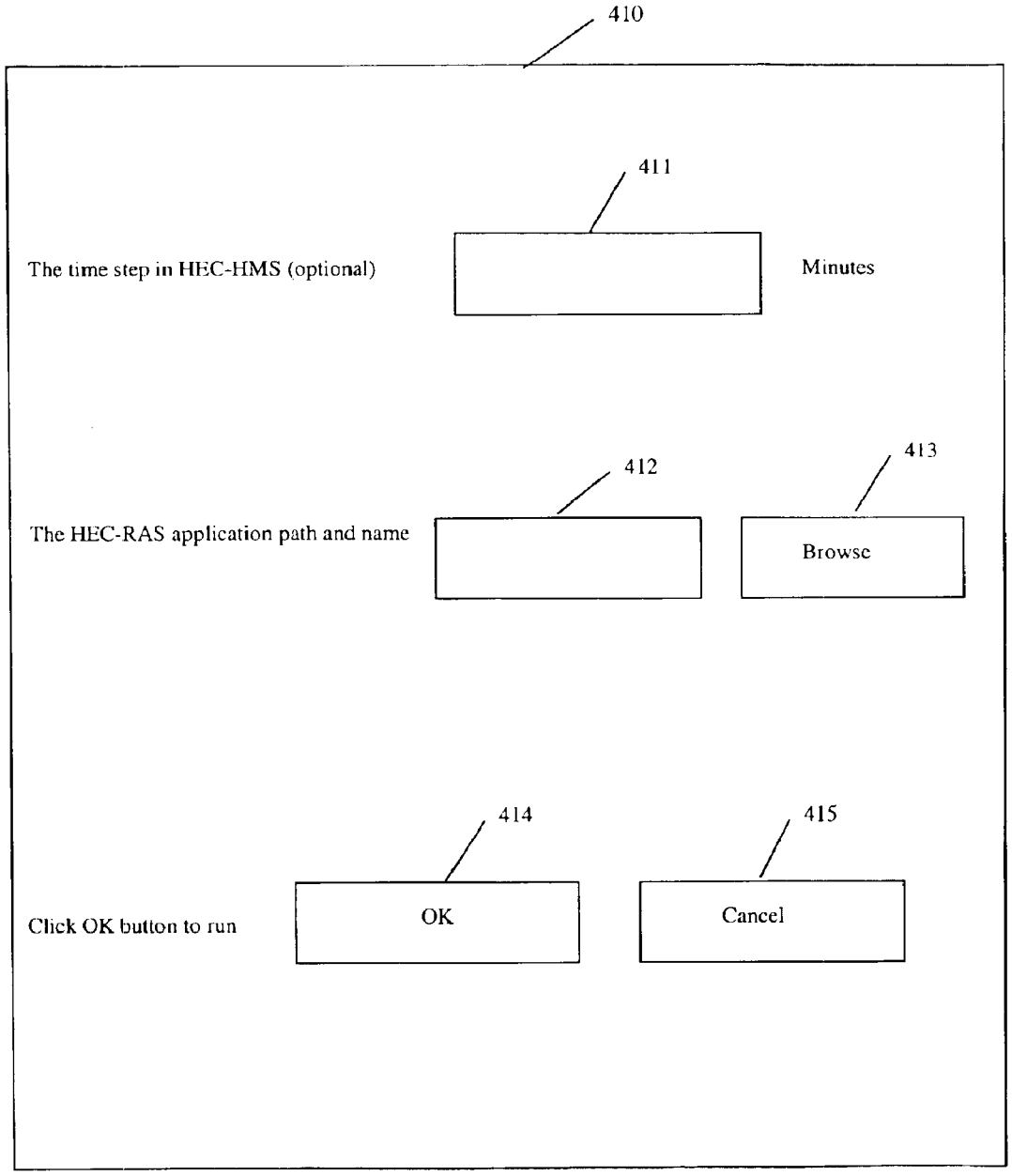
FIG. 4B illustrates an example of the user interface control setting that may be used in the function of Calculating Storage-Outflow Relationship.

With reference to FIG. 4B, which is the illustration of the input form 410 that pops up after a user clicking the function Calculate Storage-Outflow Relationship. The time step interval used in HEC-HMS program can be specified in textbox 411, but it is optional. If the time step is specified, the function will use it to determine the time steps (Total travel time/time step interval). The user can click the Browse button 413 to setup the directory and name of the HEC-RAS program in the textbox 412. This just needs to be done once, and the function will remember that setting. Clicking the OK button 414 will make the function proceed to do the calculation communicating with the HEC-RAS application and the spreadsheet application. After clicking the Cancel button 415, the function will exit.

In order to facilitate the user input and standardize the output, there is a spreadsheet format file named "RAStemplateN" is accompanied with this module, the format file mainly contains three sheets, one for the input data called "Reach-End-Locations (Input)" and two for output data named "Slope-Conveyance (Result)" and "Storage-Outflow-Time (Result)" respectively. There are three columns in the "Reach-End-Locations (Input)" sheet, and they are Reach Name, HEC-RAS Cross Section NO., and HEC-HMS Node Name. This sheet is used to build the relationship between hydrology nodes and hydraulic cross sections. There are several columns in the "Slope-Conveyance (Result)" sheet, and they are Stations, Average Slope, and Percentage Flow in Main Channel for each profile; There are several columns in the "Storage-Outflow-Time (Result)", and they are Reach Storage, Out Flow, Travel Time for each profile, and average travel time and time steps for each profile. Vertically the results sheets will be separated by reach name and reach station range. An example of the format file can be seen in FIG. 4C.

Referring to FIG. 4C now, 420 is the input sheet "Reach-End-Locations (Input)", 430 is the output sheet "Slope-Conveyance (Result)", and 440 is the other output sheet "Storage-Outflow-Time (Result)". Please note in this example, there are two reaches and three profiles.

Figure 4D:
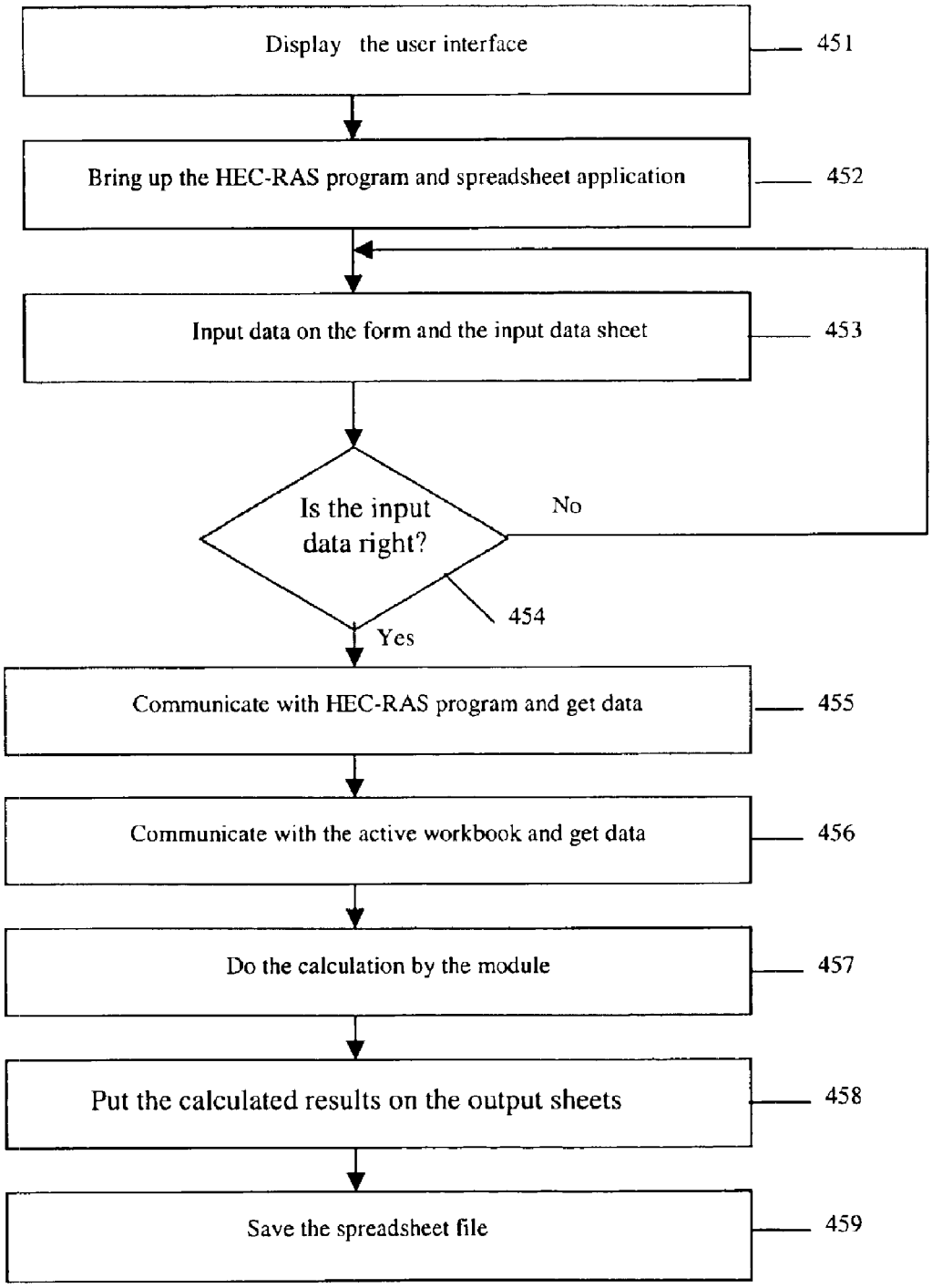
FIG. 4D illustrates a flow diagram of a process for the slope, conveyance and storage-outflow calculation.

FIG. 4D illustrates a flow diagram of a process for slope, conveyance and storage-outflow calculation. For explanation purpose, the steps of FIG. 4D will be described in reference to the components of FIG. 4A, FIG. 4B and FIG. 4C.

At step 451, a user interface is displayed to allow the user to calculate slope and conveyance or storage-outflow. For example, the user may be presented with a user interface 400 or 410 as previously described in FIG. 4A or FIG. 4B respectively.

At step 452, the function brings up the HEC-RAS program and the spreadsheet application. The user can open the existing HEC-RAS project, and input data on the user form and on the new or existing input data spreadsheet at step 453. The user may be presented with an input sheet 420 as previously described in FIG. 4C. If this is not the first time run of the function, the user can open the spreadsheets saved from last time.

At step 454, a determination is made by checking whether the format of input data and engineering concepts are followed. If the data is not right, the function will prompt the user the problem and go back to step 453; If everything is right, the function will proceed to step 455 to communicate the active HEC-RAS program and receive data from the user defined tables in the current run plan. An alternative here is to read in the text files exported from HEC-RAS user-defined tables. Then the function communicates with the active spreadsheet program to receive the input data at step 456. Finally the function starts the calculation at step 457.

The function will calculate the average channel slope between any two user-specified stations on the input sheet. A best-fit line passing all the points between the two stations is determined and its slope is the average channel slope. Traditionally the slope calculation is done by just using that two stations, this new way of the present invention can eliminate any sudden local change in elevation and reflect the real trend of the channel bottom. The function calculates the average percentage of flow in main channel using length-weighted method. Since any cross section between the two user specified stations has a percentage of flow in channel, this new way of calculation in the present invention can reflect the real conveyance for that part of channel. The function calculates storage-outflow relationship based the volume difference between any two user specified stations and the flow rates in that part of channel. The number of the pair of data depends on how many profiles the user has selected in the HEC-RAS output table, but the function adds one more pair (0,0) at the beginning of the pairs to reflect the starting point.

After finishing the calculation, at step 458 the function will place the results on the two output spreadsheets 430 and 440 as previously described in FIG. 4C. Finally, the user need to save the calculation result at step 459, this saved sheets can be used for the next round run if the HEC-RAS model is modified later on.

When we calculate conveyance percentage as mentioned previously, the peak flow rates for the conveyance plan of the HEC-RAS project need to be determined first if not given by other studies. We will describe in detail how to get the conveyance flow rates in the following several paragraphs.

The channel conveyance flow rate reflects the ability of the channel can convey the flow. One of the factor that affecting the flow rates is the cumulative drainage area and development percentage contributing to that piece of channel. The HEC-HMS Pre-Processor module controls the spreadsheet program and the HEC-HMS basin file, and it communicates with them when calculating the cumulative drainage area and development percentage.

Figure 4E:
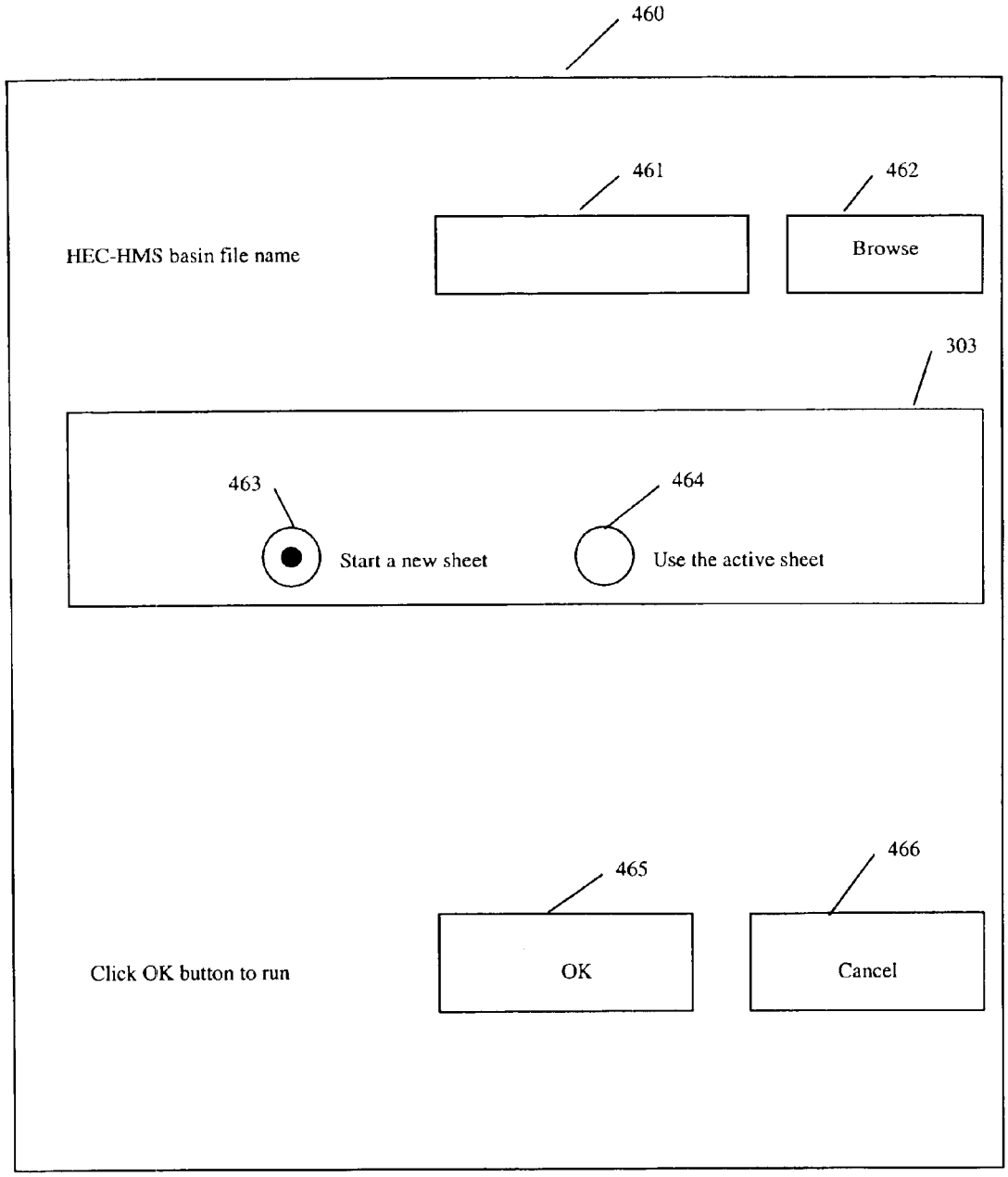
FIG. 4E illustrates an example of the user interface control setting that may be used in the function of Calculating Cumulative Area and Development Percentage.

With reference to FIG. 4E, which is the illustration of the input form 460 that pops up after a user clicking the function Calculate Cumulative Area and Development Percentage. The user can click the Browse button 462 to setup the directory and name of the HEC-HMS basin file in the textbox 461. There are two option items 463 and 464, and only one of them can be selected. If the "Start a new Sheet" is selected, the function will automatically create a new blank sheet with the designed format; if the "Use the Active Sheet" is selected, the function will use the active sheet of the active workbook as the input assuming it follows the designed format. Clicking the OK button 465 will make the function proceed to do the calculation communicating with the HEC-HMS basin file and the spreadsheet application. After clicking the Cancel button 466, the function will exit.

Figure 4F:
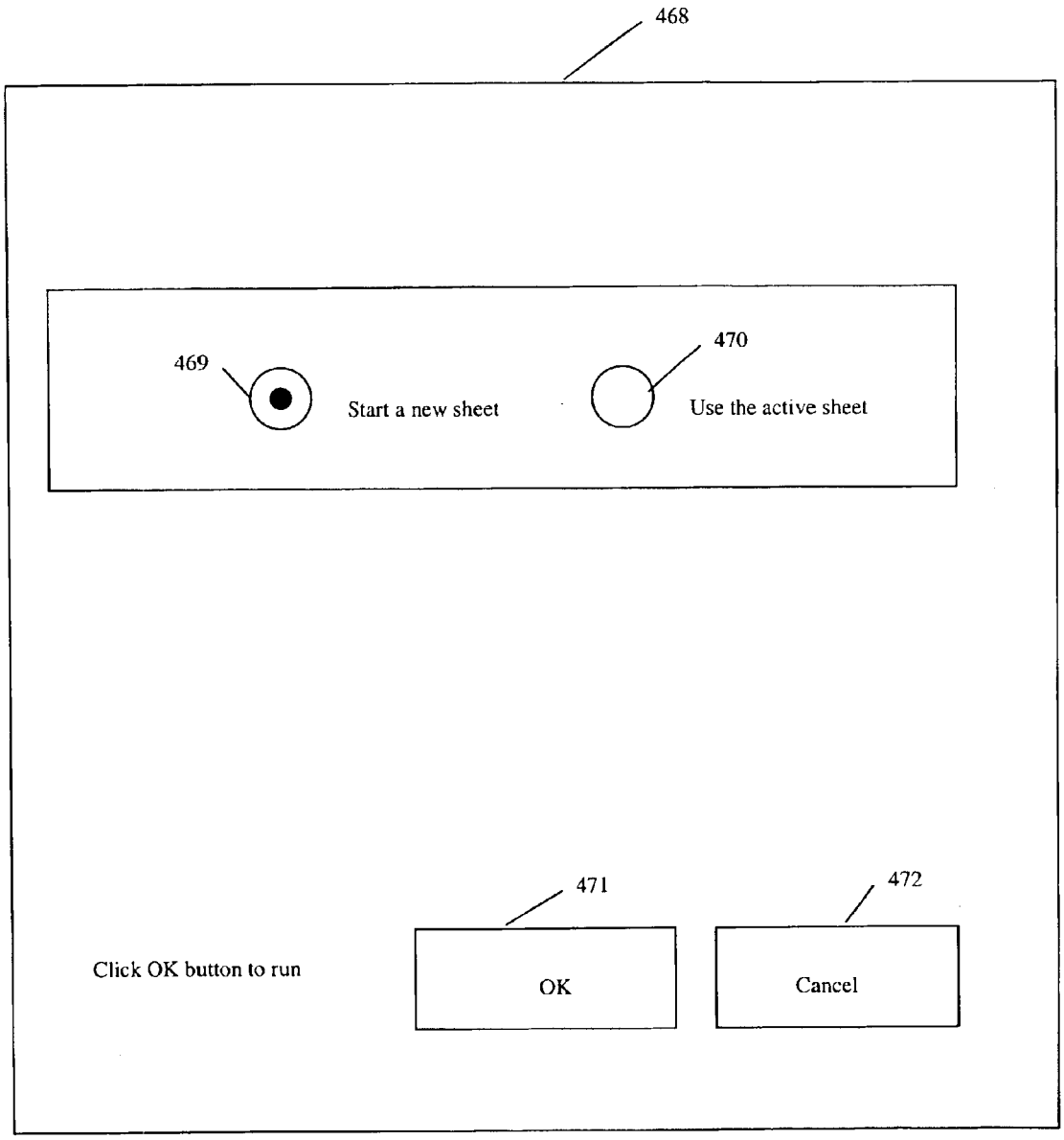
FIG. 4F illustrates an example of the user interface control setting that may be used in the function of Calculating Conveyance Flow Rates.

With reference to FIG. 4F, which is the illustration of the input form 468 that pops up after a user clicking the function Calculate Conveyance Flow Rates. There are two option items 469 and 470, and only one of them can be selected. If the "Start a new Sheet" is selected, the function will automatically create a new blank sheet with the designed format; if the "Use the Active Sheet" is selected, the function will use the active sheet of the active workbook as the input assuming it follows the designed format. Clicking the OK button 471 will make the function proceed to do the calculation communicating with the HEC-HMS basin file and the spreadsheet application. After clicking the Cancel button 472, the function will exit.

As mentioned above, there is a designed spreadsheet format inside the HEC-HMS Pre-Processor module for both the calculations of the cumulative area and development percentage and the calculation of the conveyance flow rates. The detail of the format file can be seen from an example in FIG. 4G. With reference to FIGS. 4G-1, 475 is an example of input data for the calculation of the cumulative area and development percentage. 475 has four input columns, and they are Subbasin Name, Subbasin Area, Subbasin Development Percentage, and Corresponding HMS Node Name; 476 is the output and has four columns to the right side of the input columns in 475, and they are Subbasin Name, Corresponding HMS Node, Cumulative Area, and Cumulative Development Percentage. With reference to FIGS. 4G-2, 477 is an example of input and output data for the calculation of conveyance flow rates. 477 has four input columns, and they are Channel Slope (ft/ml), Development (%), Area (acres), and Description, and has one output column Flow Rates (cfs).

Figure 4H:
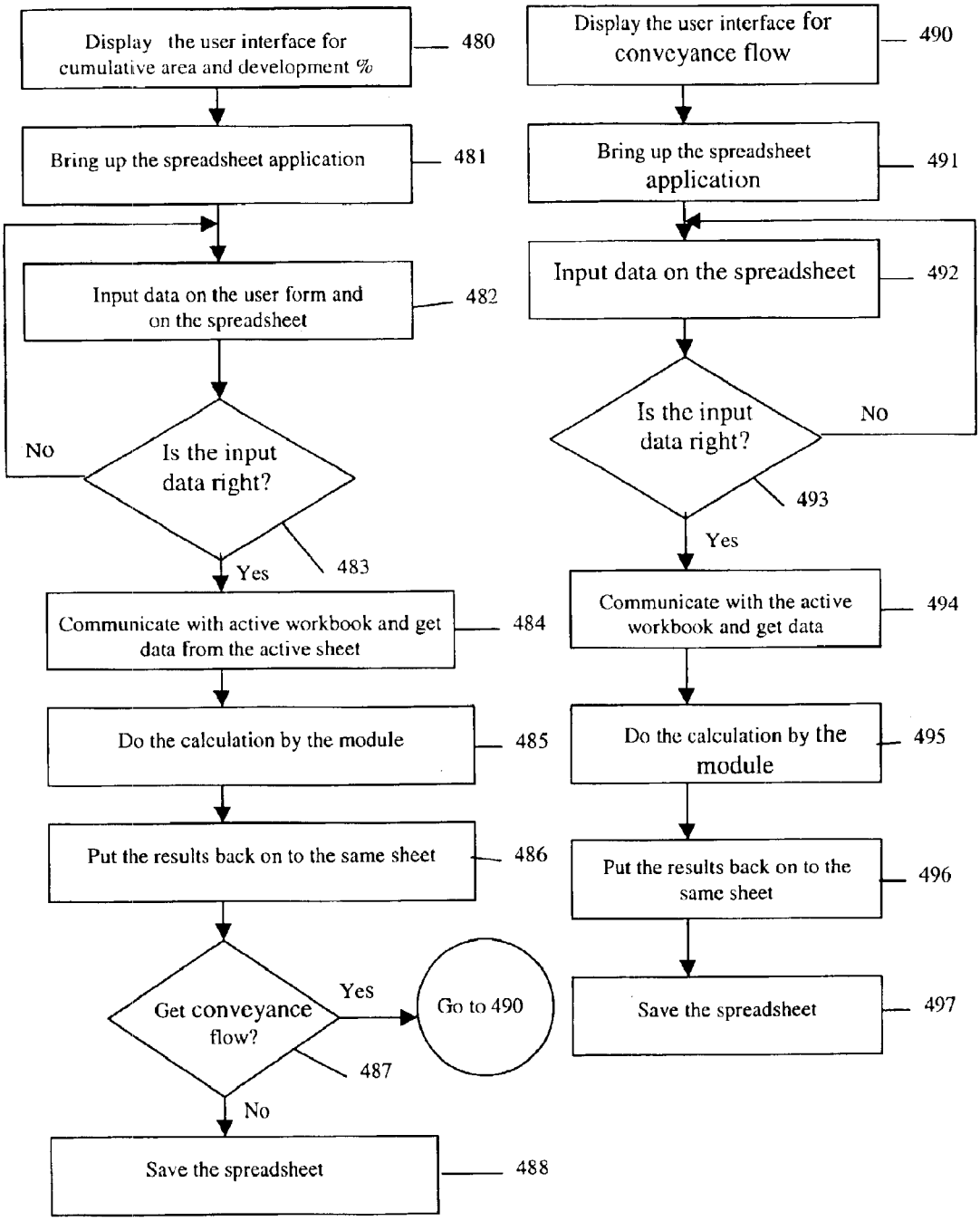
FIG. 4H illustrates a flow diagram of a process for the cumulative drainage area, development percentage and conveyance flow calculation.

FIG. 4H illustrates a flow diagram of a process for the calculation of cumulative area and development percentage and the calculation of the conveyance flow rates. For explanation purpose, the steps of FIG. 4H will be described in reference to the components of FIG. 4E, FIG. 4F and FIG. 4G.

At step 480, a user interface is displayed to allow the user to calculate the cumulative area and development percentage. For example, the user may be presented with a user interface 460 as previously described in FIG. 4E.

At step 481, the function brings up the spreadsheet application. The user can input data on the user form and on the new or existing input data spreadsheet at step 482. The user may be presented with an input sheet 475 as previously described in FIG. 4G. If this is not the first time run of the module, the user can open the spreadsheets saved from last time.

At step 483, a determination is made by checking whether the format of input data and engineering concepts are followed. If the data is not right, the function will prompt the user the problem and go back to step 482; If everything is right, the function will proceed to step 484 to communicate with the active spreadsheet program to receive the input data from the active sheet. Finally the function starts the calculation at step 485.

The function calculates the cumulative area and development percentage based on the connection network in the HEC-HMS basin file. Using value on the column of Corresponding HEC-HMS Node Name, the function finds all the components upstream of that node in the HEC-HMS model including that node. Then the function calculates the cumulative area of all those nodes. Finally the function calculates the area weighted development percentage of all those nodes using the area development percentage for each subbasin listed on the spreadsheet. Please note that both the area and development percentage are assumed to be zero for the components without an area.

After finishing the calculation, at step 486 the function will place the results back to the same spreadsheet to the right side of the input data. At step 487, a determination is made on whether to continue the calculation of conveyance flow. If it is true, go to step 490; if not, go to step 488 to save the spreadsheet.

At step 490, a user interface is displayed to allow the user to calculate the conveyance flow rates. For example, the user may be presented with a user interface 468 as previously described in FIG. 4F.

At step 491, the function brings up the spreadsheet application. The user can input data on the new or existing input data spreadsheet at step 492. The user may be presented with an input sheet 476 as previously described in FIG. 4G. If this is not the first time run of the function, the user can open the spreadsheets saved from last time.

At step 493, a determination is made by checking whether the format of input data and engineering concepts are followed. If the data is not right, the function will prompt the user the problem and go back to step 492; If everything is right, the function will proceed to step 494 to communicate with the active spreadsheet program and receive the input data from the active sheet. Finally the function starts the calculation at step 495.

The function calculates the conveyance flow rates based on a database built from an engineering chart. Using values on the columns of Channel Slope (ft/ml), Development (%), and Area (acres), the function will interpolate or extrapolate to get the conveyance flow rates from the key values in the database.

After finishing the calculation, at step 496 the function will place the results back to the same spreadsheet on the column Flow Rates (cfs). Finally, the user need to save the calculation result at step 497, this saved sheets can be used for the next round run if the input data is modified later on.

Any flow rates calculated from HEC-HMS program as we mentioned previously is under a certain storm. This storm can be historical storm or simulated storm. For historical storm, the rainfall data is recorded by rainfall gages from different organizations. We usually pick several recorded storms to do the calibration of HEC-HMS models. Not only rainfall gages are needed, but also stream gages are needed in the calibration. As we mentioned previously, the amount of data for both kinds of gage are huge for a whole watershed. Since the common format of the gage data is table shape that is usually presented in spreadsheets, the HEC-HMS Pre-Processor module provides a function to automatically import gage data into HEC-IBMS DSS database, and automatically assign a unique gage ID to each gage.

Figure 4I:
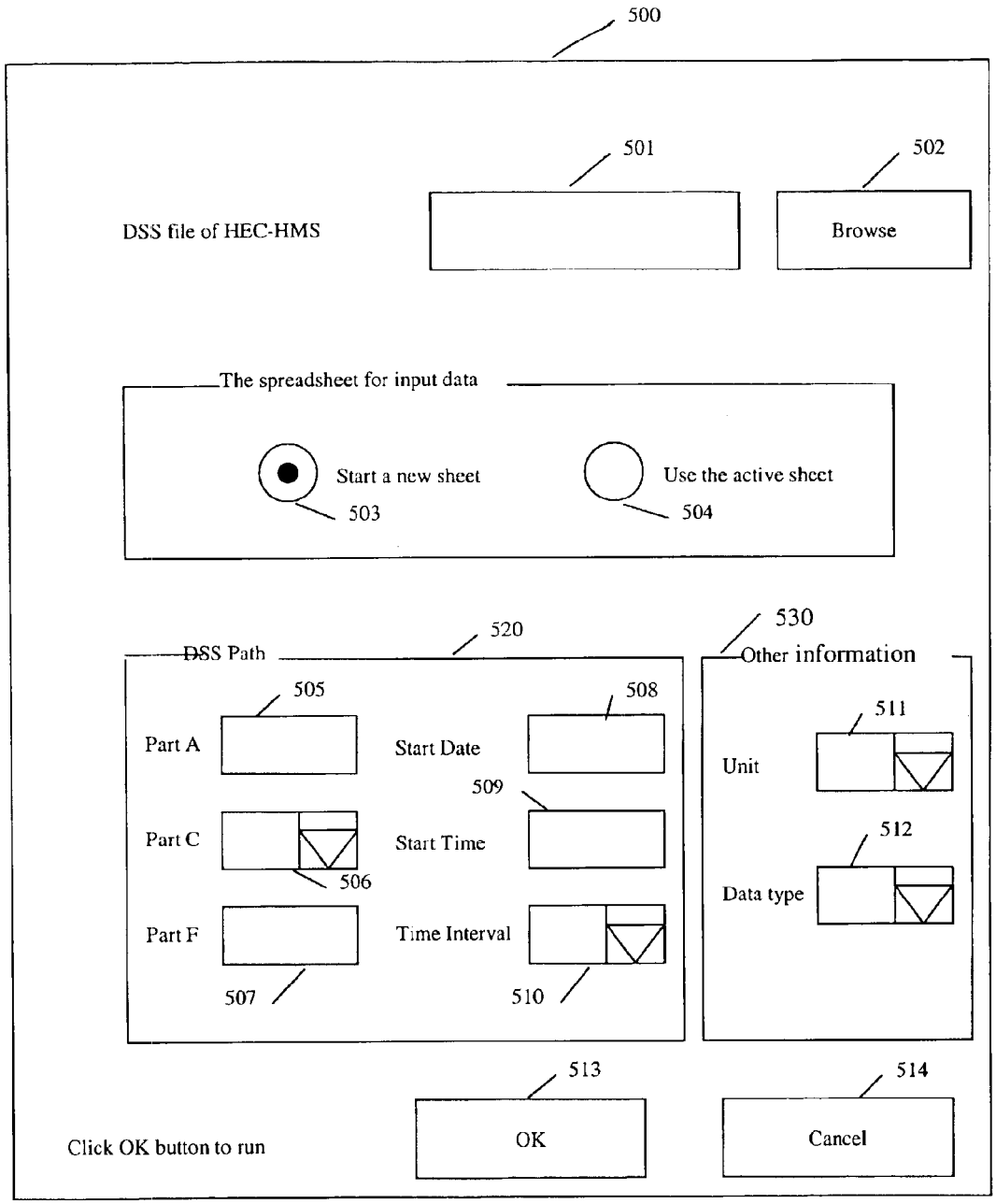
FIG. 4I illustrates an example of the user interface control setting that may be used in the function of Importing Gage Data.

With reference to FIG. 4I, which is an illustration of the input form 500 that pops up after a user clicking the function Import Gage Data. By clicking the Browse button 502 the selected HEC-HMS DSS database file will be listed in the textbox 501. There are two option items 503 and 504, and only one of them can be selected. If the "Start a new Sheet" is selected, the function will automatically create a new blank sheet with the designed format; if the "Use the Active Sheet" is selected, the function will use the active sheet of the active workbook as the input assuming it follows the designed format. Frame 520 and 530 is used to specify some path information for the DSS database. Textbox 505 is used to specify the watershed name or ID. In ComboBox 506, the user can select the type of the gage, such as FLOW and PRECIP-INC. Textbox 507 is optional, and can be used to add some comments. Textbox 508 and 509 are used to specify the starting date and starting time respectively. The user can use the ComboBox 510 to select the standard DSS time interval such as 5 MIN and 15 MIN. The units used such as inches and cfs can be selected in the ComboBox 511, and the data type such as Instant Flow and Incre. Precip. can be selected in ComboBox 512. Clicking the OK button 513 will make the function proceed to do the calculation communicating with the HEC-HMS DSS database and the spreadsheet application. After clicking the Cancel button 514, the function will exit.

There is also a designed spreadsheet format associated with importing gage data. The detail of the format file can be seen from an example in FIG. 4J. With reference to FIG. 4J, 520 is an example of gage data to be imported. 521 and 522 showed parts of two rainfall gages, and the same format can be applied to the stream gage data. As we can see from FIG. 4J, there are four columns: Gage ID, Date, Time, and Gage Data. The Gage Data column can be rainfall data or flow data. Please note that only the Gage ID label needs to be exactly matched, the other labels can be changed as long as the data order is right.

Figure 4K:
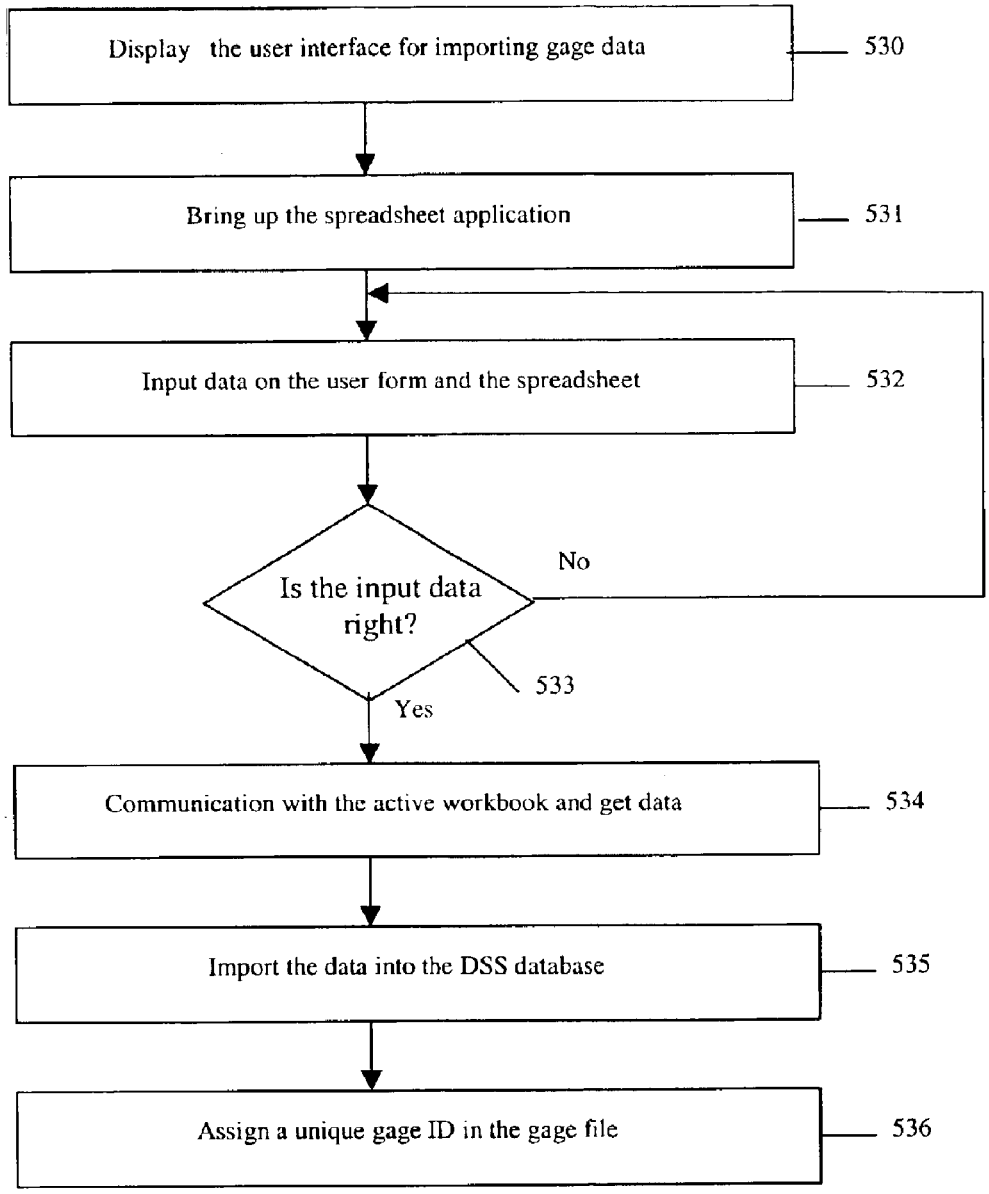
FIG. 4K illustrates a flow diagram of a process for Importing Gage Data.

FIG. 4K illustrates a flow diagram of a process for importing gage data. For explanation purpose, the steps of FIG. 4K will be described in reference to the components of FIG. 41, and FIG. 4J.

At step 530, a user interface is displayed to allow the user to import gage data. For example, the user may be presented with a user interface 500 as previously described in FIG. 41.

At step 531, the function brings up the spreadsheet application. The user can input data on the user form and on the new or existing input data spreadsheet at step 532. The user may be presented with an input sheet 520 as previously described in FIG. 4J. If this is not the first time run of the module, the user can open the spreadsheets saved from last time.

At step 533, a determination is made by checking whether the format of input data and engineering concepts are followed. If the data is not right, the function will prompt the user the problem and go back to step 532; If everything is right, the function will proceed to step 534 to communicate with the active spreadsheet program and to receive the input data from the active sheet. Finally the function starts the importing at step 535.

The function puts the data on the spreadsheet into the DSS database gage by gage, and the gage ID is part of the DSS path name. In the DSS database, the data of a gage for different storms are uniquely identified because the DSS path has the starting time for each storm. For the HEC-HMS gage file, at step 536 the function appends the starting time to the real gage name and creates a new unique gage name so that it is easy to be used and not confused by the user.

The detail about how to prepare the HEC-HMS parameter by HEC-HMS Pre-Processor has been discussed above. In the next section about HMS Input Converter, we will discuss how to convert those parameters into HEC-HMS basin file and DSS database quickly without typing or pasting.

HMS Input Converter

HMS Input Converter converts the spreadsheets containing the required hydrology parameters to the basin file and DSS database of HEC-HMS program automatically. The HMS Input Converter module controls the spreadsheet program and the HEC-HMS files, and it communicates with them when doing the data conversion, aligning the components, and cleaning the HEC-HMS project. There is also a geometry file to be used, and it is a comma separate text file with three columns: item name, x coordinate, and y coordinate.

Figure 5A:
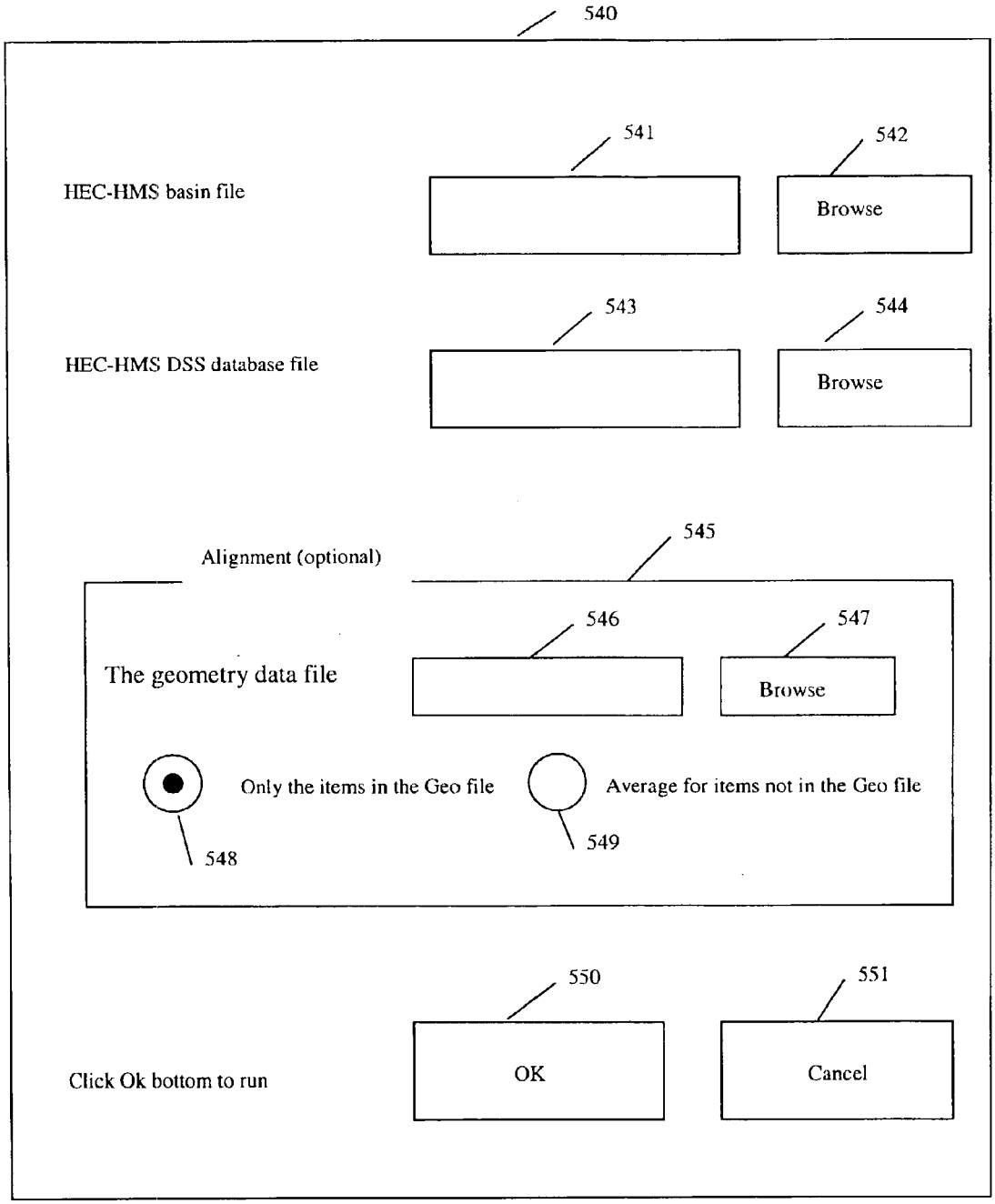
FIG. 5A illustrates an example of the user interface control setting that may be used in the module of HMS Input Converter.

With reference to FIG. 5A, which is an illustration of the input form 540 that pops up when the user run the module. The user can click the Browse button 542 to setup the HEC-HMS basin file name in the textbox 541, and click the Browse button 544 to setup the HEC-HMS DSS database name in the textbox 543. The items contained in frame 545 is optional, and they are used if the user wants to align the HEC-HMS component with the GIS coordinates. Clicking the Browse button 547 will select a geometry data file generated from GIS components and place it in the textbox 546. There are two option items 548 and 549, and only one of them can be selected. If the "Only Items in the Geo-File" is selected, the function will only update the coordinates of the basin items in the geo-file; if the "Average for items not in the Geo-file" is selected, in addition to the ones in the geo-file the function will update the coordinates of the basin items not in the geo-file with the average coordinates. The result of the second option is that the non-georeferenced items will be crowded around the center of the watershed with a little shifting. Clicking the OK button 550 will make the function proceed to do the conversion communicating with the HEC-HMS files and the spreadsheet application. After clicking the Cancel button 551, the function will exit.

There is a designed spreadsheet format inside the HMS Input Converter module for all the data to be converted. The detail of the format file can be seen from an example in FIG. 5B. With reference to FIG. 5B, there are four spreadsheets in this format file, and they are Basins sheet 560 containing subbasin parameters, Reaches sheet 561 containing reach name and routing steps etc., Reservoirs sheet 562 containing reservoir name and routing methods etc., and DSS Tables sheet 563 containing the SV-SQ, SE-SV-SQ, DI-DQ relationship data for reach, reservoir and diversion respectively.

Figure 5C:
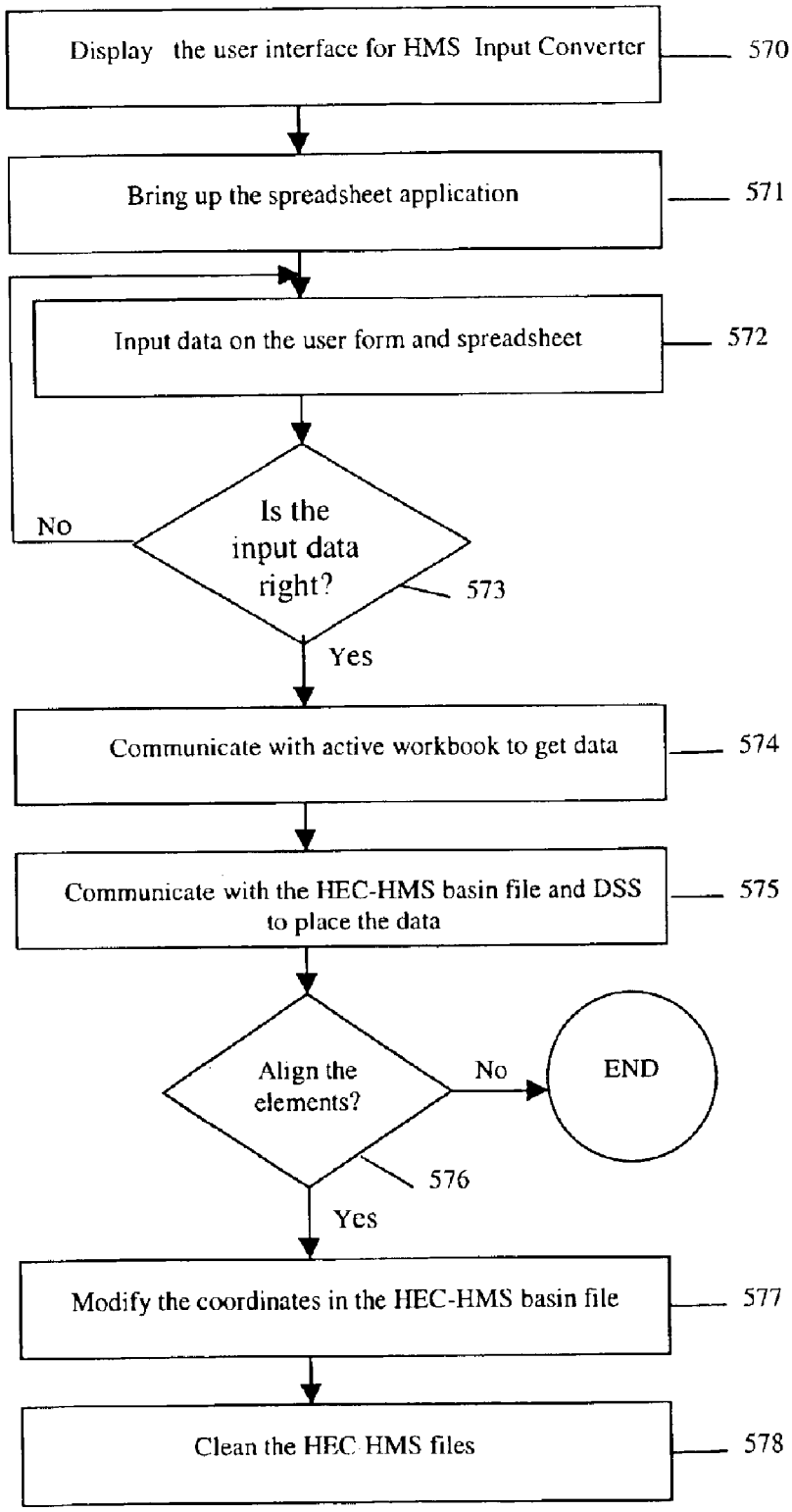
FIG. 5C illustrates a flow diagram of a process for HMS Input Converter.

FIG. 5C illustrates a flow diagram of a process for HMS Input Converter module. For explanation purpose, the steps of FIG. 5C will be described in reference to the components of FIG. 5A, and FIG. 5B.

At step 570, a user interface is displayed to allow the user to convert the HEC-HMS input data. For example, the user may be presented with a user interface 540 as previously described in FIG. 5A.

At step 571, the function brings up the spreadsheet application. The user can input data on the user form and on the new or existing input data spreadsheet at step 572. The user may be presented with four input sheets 560, 561, 562 and 563 as previously described in FIG. 5B. If this is not the first time run of the module, the user can open the spreadsheets saved from last time.

At step 573, a determination is made by checking whether the format of input data and engineering concepts are followed. If the data is not right, the function will prompt the user the problem and go back to step 572; If everything is right, the function will proceed to step 574 to communicate with the active spreadsheet program to receive the input data from the active workbook. Finally the function starts to communicate with the HEC-HMS basin file and DSS database to place the data at step 575.

The function converts the subbasin parameters such as area and impervious rate, reach parameters such as routing method and SV-SQ, reservoir parameters such as routing method and SE-SV-SQ, and the diversion DI-DQ to HEC-HMS files. If in the files there is an old existing value, new value will overwrite the old one. The brand new values will be inserted into the files.

After finishing the conversion, a determination is made by the user to see whether needs to align the HEC-HMS components to the GIS coordinates at step 576. This usually needs to be done once when the user is setting up the HEC-HMS model for the first time. For other rounds, most likely the coordinates will not change and program will end at step 575. If user chooses to do the alignment, the function will proceed to step 577.

At step 577, as we mentioned previously, the program changes the coordinates with two cases. If the second one "Average for items not in the Geo-file" is picked, the non-georeferenced components will be crowded around the center with a little shifting. This is because the program calculates the average x and y coordinates from all the coordinates in the geometry file, then uses the average value as a base, and shift a little for any non-georeferenced item. Doing this, the user can easily move the components around to their right locations, especially when following a background map.

At step 588, the function will clean the HEC-HMS files. The HEC-HMS program remembers the absolute path of all the files. When users deliver a project to their customers, there will be a problem to use it if the complete directory is not provided. This function automatically changes all the absolute paths to relative ones in the HEC-HMS files.

Through all the efforts above, we can run the HEC-HMS model and get the flow rates. These flow rates cannot be applied to the HEC-RAS model directly yet because they are just at the hydrological nodes that are usually very far away from each other. The difference of the flow rates between any two nodes is often very big, and usually we want this difference to be close to five percent. Therefore flow interpolation is needed to reduce the flow variance. Sometimes HEC-RAS cross-sections are located beyond the most upstream hydrological nodes, and flow extrapolation is needed to predict the flow. Both the flow interpolation and extrapolation are time consuming and will be updated frequently, and HEC-RAS pre-Processor automated these two calculations flexibly.

HEC-RAS Pre-Processor

HEC-RAS Pre-Processor calculates the hydraulic parameters to prepare the input data for HEC-RAS program automatically. It controls the spreadsheet program and the HEC-HMS files, and communicates with them when retrieving the area and peak flow rates, extrapolating flow, and interpolating flow.

Figure 6A:
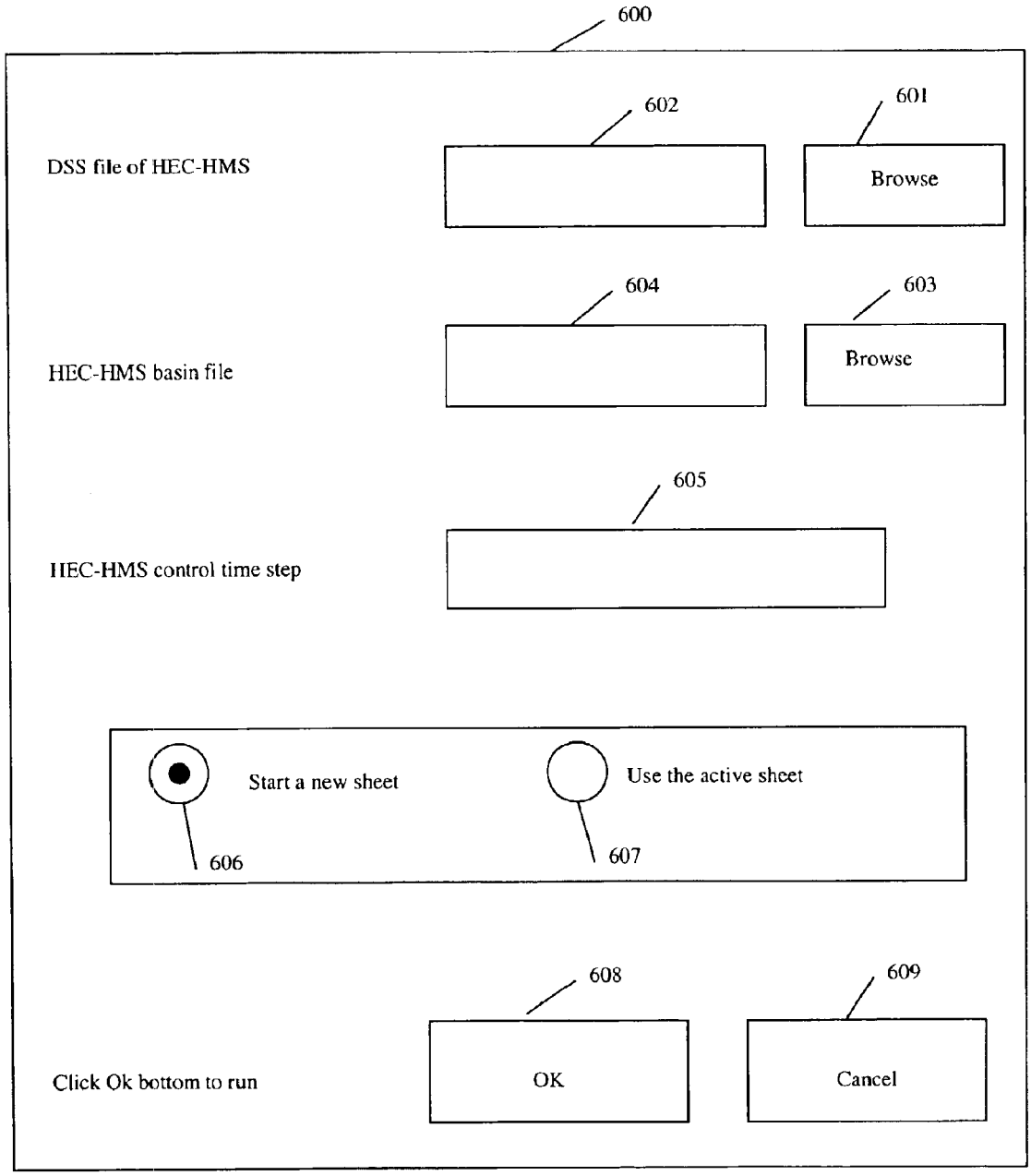
FIG. 6A illustrates an example of the user interface control setting that may be used in the function of Retrieving Drainage Area and Peak Flow Rates.

With reference to FIG. 6A, which is an illustration of the input form 600 that pops up when the user run the function Retrieve Area and Peak Flow. The user can click the Browse button 601 to setup the HEC-HMS DSS database name in the textbox 602, click the Browse button 603 to setup the HEC-HMS basin file name in the textbox 604, and select the HEC-HMS control time step in the Combobox 605. There are two option items 606 and 607, and only one of them can be selected. If the "Start a new Sheet" is selected, the function will automatically create a new blank sheet with the designed format; if the "Use the Active Sheet" is selected, the function will use the active sheet of the active workbook as the input assuming it follows the designed format. Clicking the OK button 608 will make the function proceed to do the calculation communicating with the HEC-HMS files and the spreadsheet application. After clicking the Cancel button 609, the function will exit.

There is a designed spreadsheet format inside the HEC-RAS Pre-Processor module for the function Retrieve Area and Peak Flow. The detail of the format file can be seen from an example in FIG. 6B. With reference to FIG. 6B, 610 contains two input columns: HMS-Runs and HEC-HMS Node Locations, and 611 is the result part including node name, area and peak flows for each storm. Please note that there are two storms in this example.

Figure 6C:
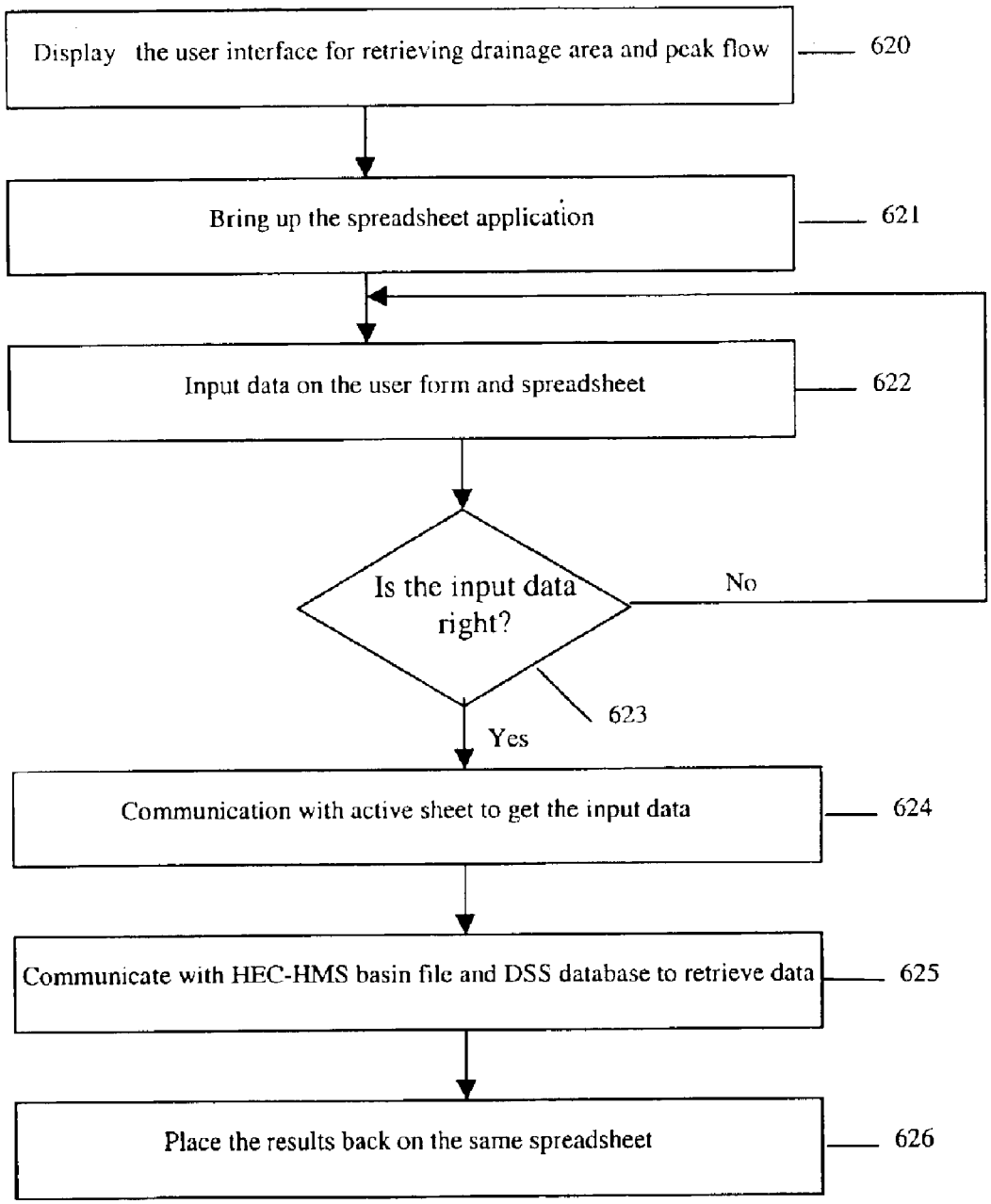
FIG. 6C illustrates a flow diagram of a process for the function of Retrieving Drainage Area and Peak Flow Rates.

FIG. 6C illustrates a flow diagram of a process for the function Retrieve Area and Peak Flow. For explanation purpose, the steps of FIG. 6C will be described in reference to the components of FIG. 6A, and FIG. 6B.

At step 620, a user interface is displayed to allow the user to retrieve area and peak flow. For example, the user may be presented with a user interface 600 as previously described in FIG. 6A.

At step 621, the function brings up the spreadsheet application. The user can input data on the user form and on the new or existing input data spreadsheet at step 622. The user may be presented with an input sheet 610 as previously described in FIG. 6B. If this is not the first time run of the module, the user can open the spreadsheets saved from last time.

At step 623, a determination is made by checking whether the format of input data and engineering concepts are followed. If the data is not right, the function will prompt the user the problem and go back to step 622; If everything is right, the function will proceed to step 624 to communicate with the active spreadsheet program to receive the input data from the active workbook. Finally the function starts to communicate with the HEC-HMS basin file and DSS database to retrieve the data at step 625.

The function uses the HEC-HMS basin file to retrieve the drainage area at the specified location, and retrieve the peak flow rates from the HEC-HMS DSS database. First, the program updates the description file of the DSS database, then it extracts every related record in the DSS database to a text file, finally the maximum flow rate is found from the text files. After finishing the calculation, the function puts the results on the same spreadsheet to the right of the input data for each selected node location with columns: Node Name, Area, and peak flow for each selected run at step 626.

As we mentioned earlier, if some cross sections in the HEC-RAS model are beyond the upper most hydrological node, flow extrapolation is needed. The extrapolation is based on the log-log relationship between the drainage area and flow rates. The drainage area for the special cross sections can be measured from a CAD drawing or a GIS shape file. The log-log relationship is obtained from the known drainage area and flow rates. The slope and interception value of the best-fit line passing through the known log-log points are calculated. Using these two values, the flow rates can be extrapolated linearly from the log-log line.

Figure 6D:
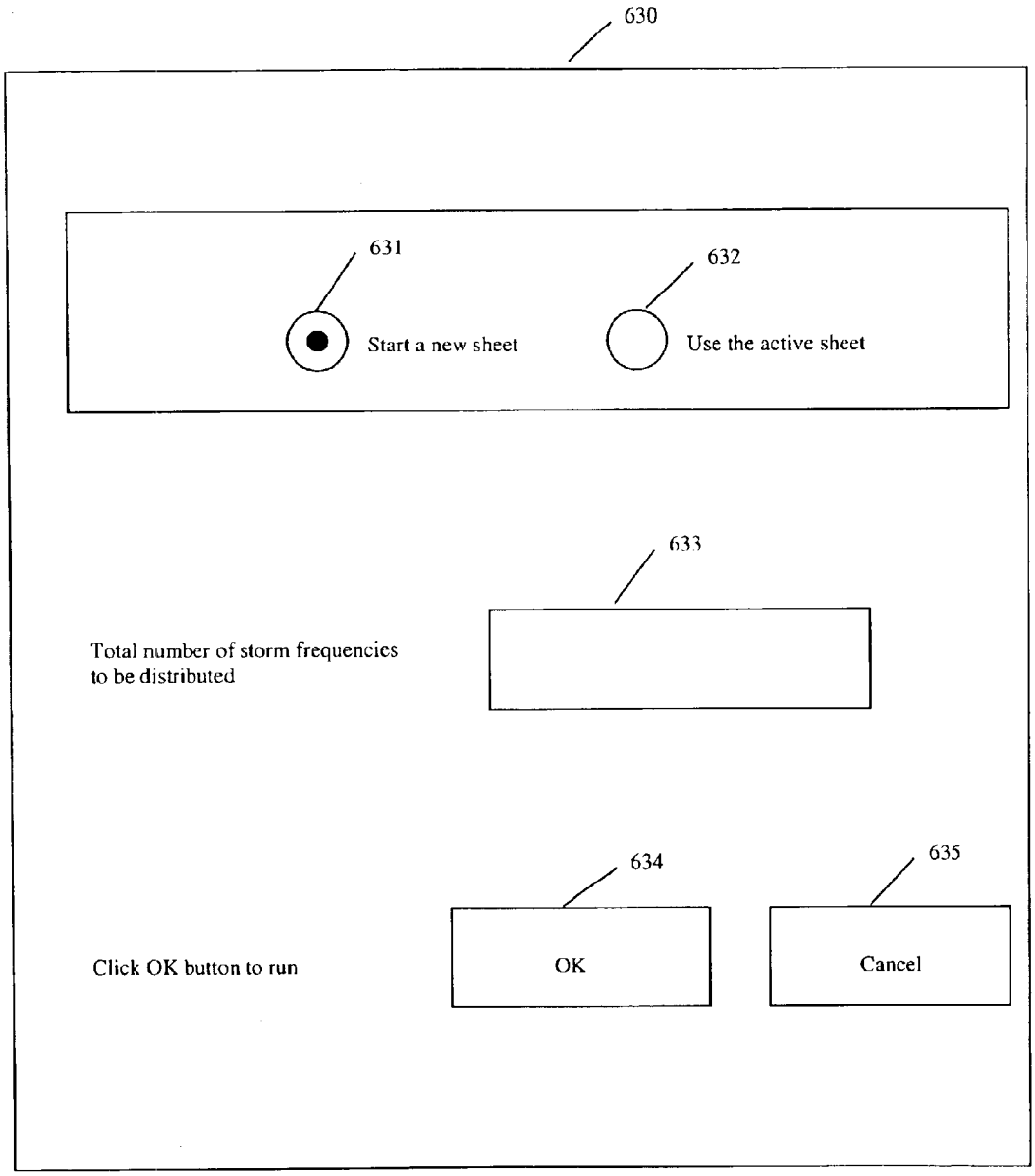
FIG. 6D illustrates an example of the user interface control setting that may be used in the function of Extrapolating Peak Flows.

With reference to FIG. 6D, which is the illustration of the input form 630 that pops up when the user run the function Extrapolate Flow. There are two option items 631 and 632, and only one of them can be selected. If the "Start a new Sheet" is selected, the function will automatically create a new blank sheet with the designed format; if the "Use the Active Sheet" is selected, the function will use the active sheet of the active workbook as the input assuming it follows the designed format. The user can specify the total number of storm frequencies in the textbox 633. Clicking the OK button 634 will make the function proceed to do the calculation communicating with the spreadsheet application. After clicking the Cancel button 635, the function will exit.

There is a designed spreadsheet format inside the HEC-RAS Pre-Processor module for the function Extrapolate Flow. The detail of the format file can be seen from an example in FIG. 6E. With reference to FIG. 6E, 640 contains several input columns, and they are Stations Beyond the Upper Most Node, Drainage Area To This Point, Node Name, Drainage Area and one flow column for each storm frequency. In this example, there are only two storms. 641 is the result of the extrapolated flows.

Figure 6F:
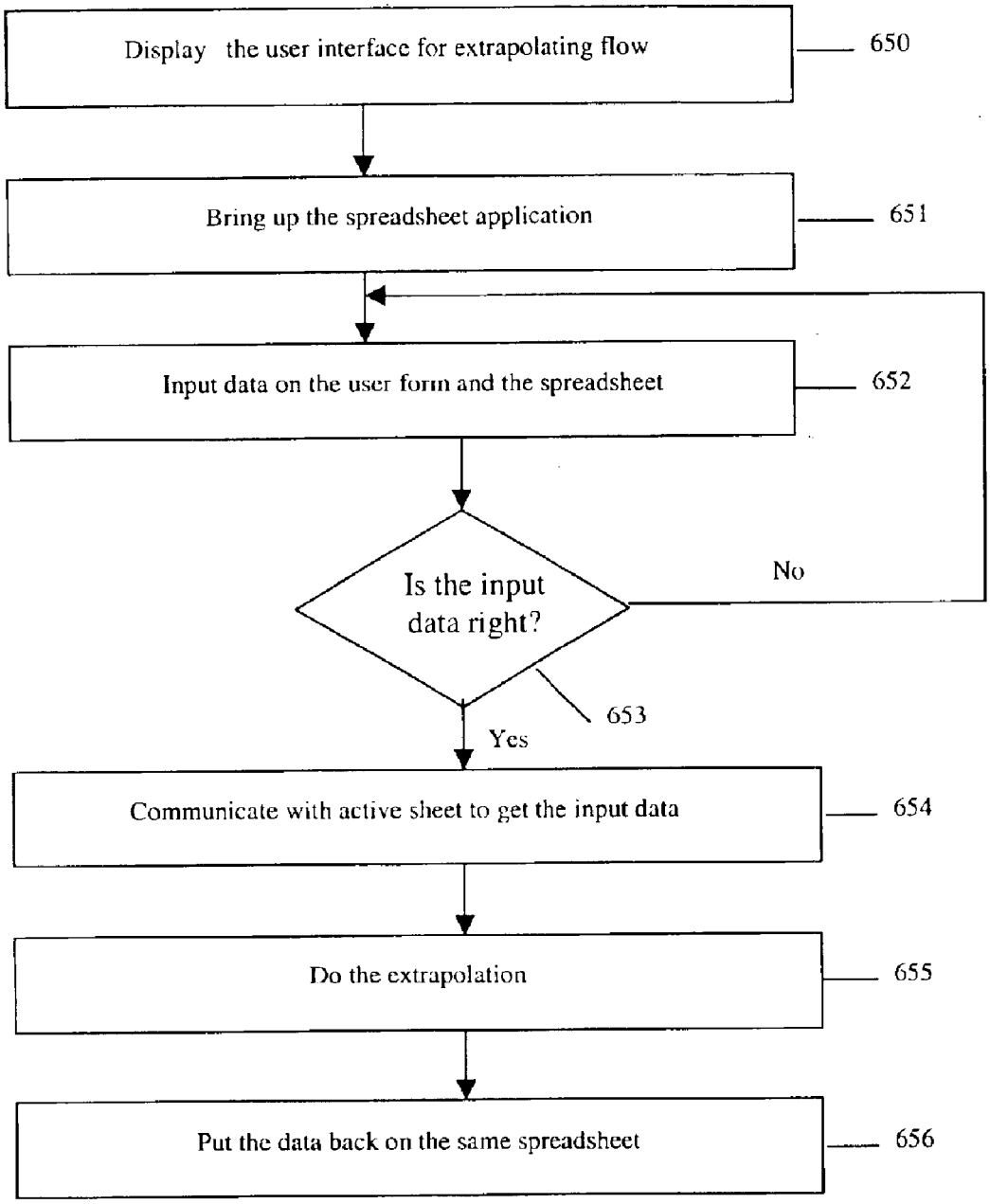
FIG. 6F illustrates a flow diagram of a process for the function of Extrapolating Peak Flows.

FIG. 6F illustrates a flow diagram of a process for the function Extrapolate Flow. For explanation purpose, the steps of FIG. 6F will be described in reference to the components of FIG. 6D, and FIG. 6E.

At step 650, a user interface is displayed to allow the user to extrapolate flow. For example, the user may be presented with a user interface 630 as previously described in FIG. 6D.

At step 651, the function brings up the spreadsheet application. The user can input data on the user form and on the new or existing input data spreadsheet at step 652. The user may be presented with an input sheet 640 as previously described in FIG. 6E. If this is not the first time run of the module, the user can open the spreadsheets saved from last time.

At step 653, a determination is made by checking whether the format of input data and engineering concepts are followed. If the data is not right, the function will prompt the user the problem and go back to step 652; If everything is right, the function will proceed to step 654 to communicate with the active spreadsheet program to receive the input data from the active workbook.

The function uses the known drainage area and the calculated log-log relationship of drainage areas and flow rates as we mentioned earlier to extrapolate the unknown flow rates at step 655. After finishing the calculation, at step 656, the function puts the results back on the same spreadsheet to the right of the input data for each special cross section with the following columns: Station #, Drainage Area, one extrapolated flow column for each storm frequency, and one flow difference column for each frequency.

As we mentioned earlier, for the cross sections in the HEC-RAS model that are between the hydrological nodes, flow interpolation is needed. The interpolation is based on the semi-log relationship between the river stations and flow rates, and the flow rates are on the logarithmic axis. The semi-log relationship is obtained from the known river stations and flow rates. The flow rates can be interpolated linearly from the semi-log line.

Figure 6G:
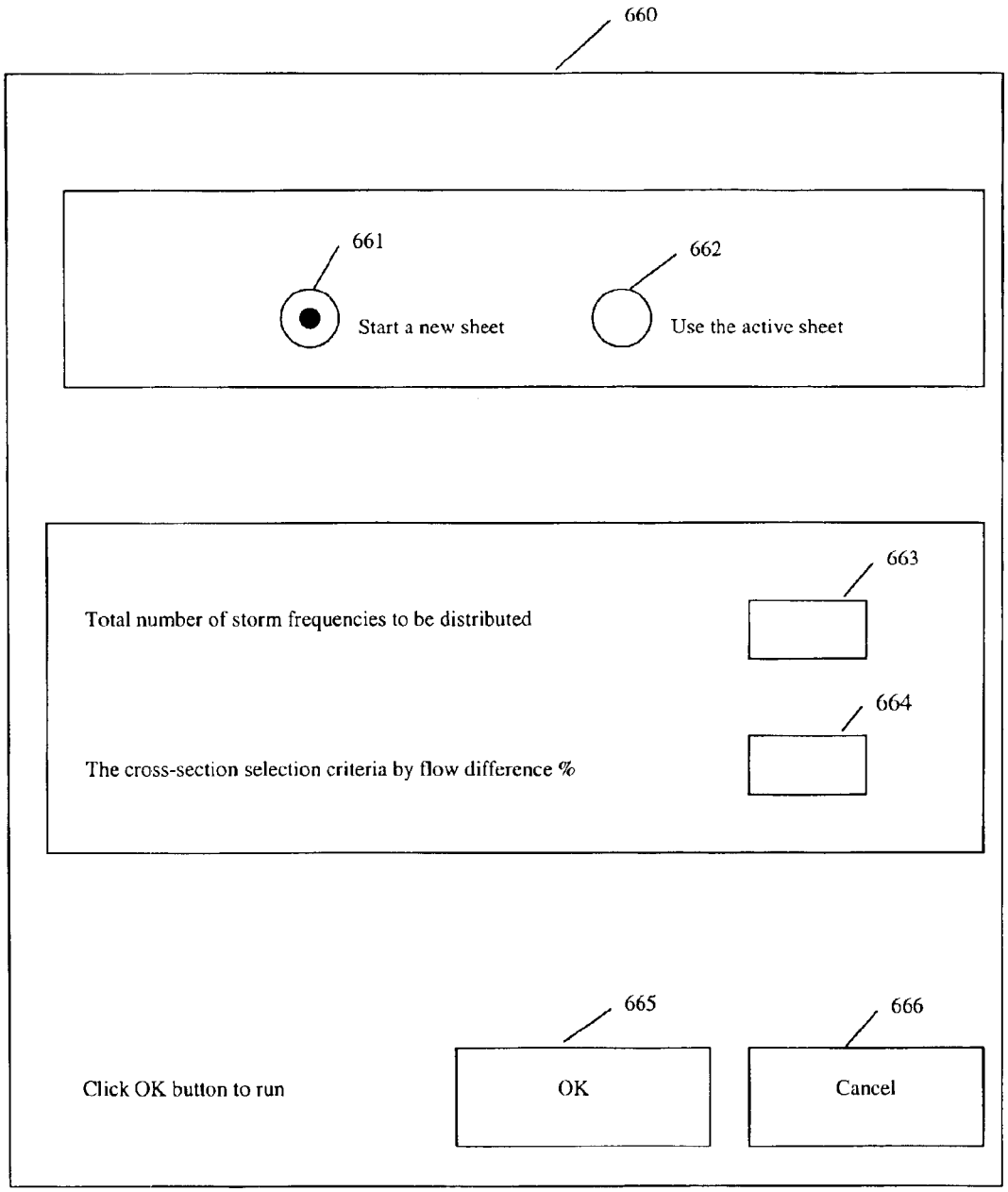
FIG. 6G illustrates an example of the user interface control setting that may be used in the function of Interpolating Peak Flows.

With reference to FIG. 6G, which is an illustration of the input form 660 that pops up when the user run the function Interpolate Flow. There are two option items 661 and 662, and only one of them can be selected. If the "Start a new Sheet" is selected, the function will automatically create a new blank sheet with the designed format; if the "Use the Active Sheet" is selected, the function will use the active sheet of the active workbook as the input assuming it follows the designed format. The user can specify the total number of storm frequencies in the textbox 663, and specify the cross section selection criteria by flow difference in the text box 664. Clicking the OK button 665 will make the function proceed to do the calculation communicating with the spreadsheet application. After clicking the Cancel button 666, the function will exit.

There is a designed spreadsheet format inside the HEC-RAS Pre-Processor module for the function Interpolate Flow. The detail of the format file can be seen from an example in FIG. 6H. With reference to FIG. 6H, 670 contains several input columns, and they are QT Stations, Hydrology Nodes, Hydraulic Stations and one flow column for each storm frequency. In this example, there are only two storms. 671 is the output of the interpolated flows and is placed to the right side of the input columns.

Figure 6I:
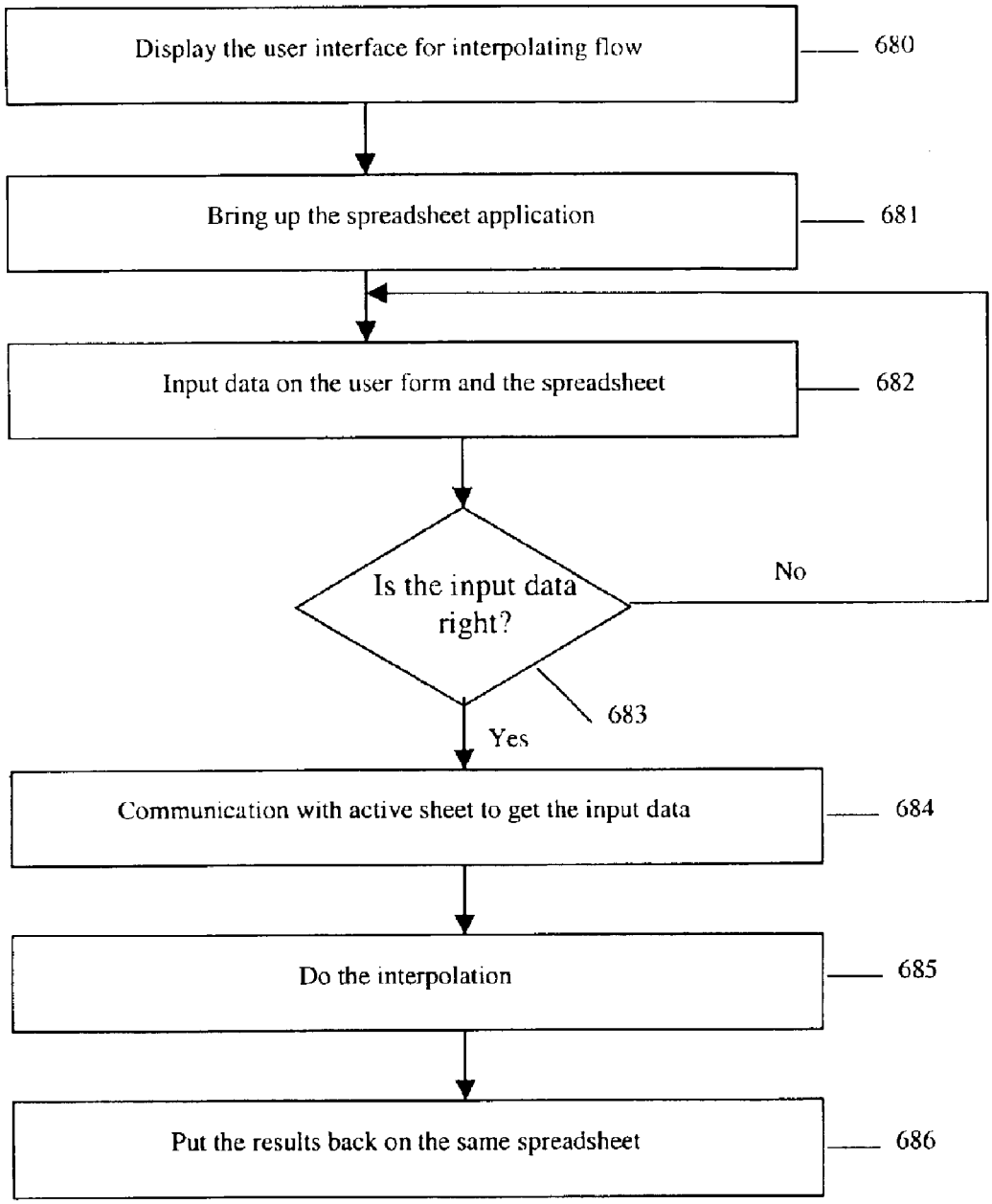
FIG. 6I illustrates a flow diagram of a process for the function of Interpolating Peak Flows.

FIG. 6I illustrates a flow diagram of a process for the function Interpolate Flow. For explanation purpose, the steps of FIG. 61 will be described in reference to the components of FIG. 6G, and FIG. 6H.

At step 680, a user interface is displayed to allow the user to interpolate flow. For example, the user may be presented with a user interface 660 as previously described in FIG. 6G.

At step 681, the function brings up the spreadsheet application. The user can input data on the user form and on the new or existing input data spreadsheet at step 682. The user may be presented with an input sheet 670 as previously described in FIG. 6H. If this is not the first time run of the module, the user can open the spreadsheets saved from last time.

At step 683, a determination is made by checking whether the format of input data and engineering concepts are followed. If the data is not right, the function will prompt the user the problem and go back to step 682; If everything is right, the function will proceed to step 684 to communicate with the active spreadsheet program to receive the input data from the active workbook The function uses the known river station and the known semi-log relationship of river stations and flow rates as we mentioned earlier to interpolate the unknown flow rates at step 685. The function also uses the user specified cross-section selection criteria to eliminate some interpolated flow rates by the difference of flow rates between cross sections. After finishing the calculation, at step 686, the function puts the results on the same spreadsheet to the right of the input data for each special cross section with the following columns: Station #, one interpolated flow column for each storm frequency, and one flow difference column for each frequency.

GIS Post-Processor

As described previously, GIS Post-Processor module maps the floodplain and floodway boundary based on the widths calculated by HEC-RAS program automatically.

The GIS Post-Processor module controls the GIS program and the HEC-RAS program, and it communicates with them when generating the boundary file. Before using this module, a user defined tables in HEC-RAS program need to be set up, but this step just needs to be done once since the HEC-RAS program will remember the user defined tables. The table is named P-Plain-Encro, and it consists of six columns: Center Station, Sta W.S. Lft, Sta W.S. Rgt, Enc Method, Base WS, and W.S. Elev from left to right.

Figure 7A:
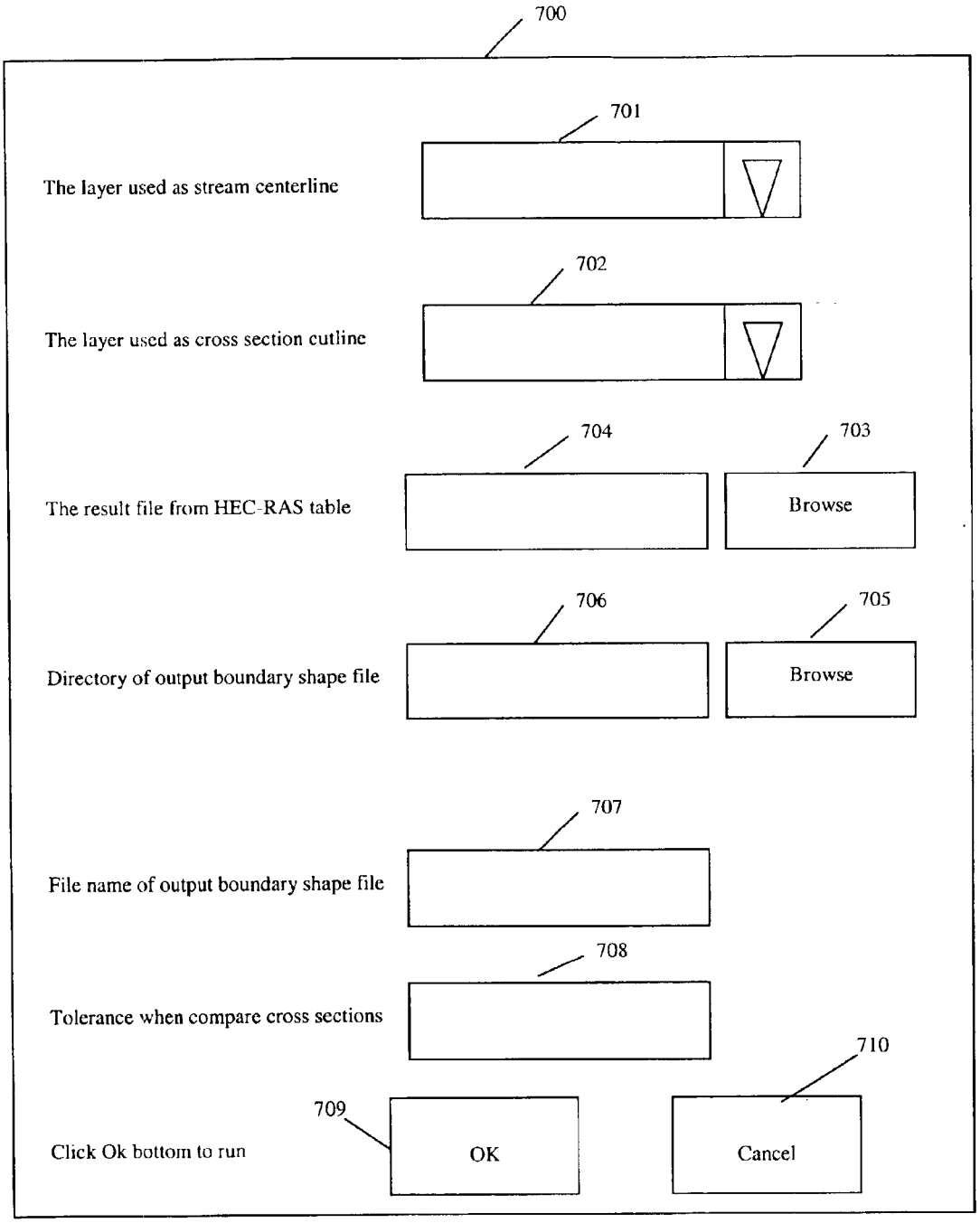
FIG. 7A illustrates an example of the user interface control setting that may be used in the function of Mapping Flood Plain and Flood Way Boundaries.

With reference to FIG. 7A, which is an illustration of the input form 700 that pops up when the user run the GIS Post-Processor module. The user can select the stream centerline layer by the combobox 701, and select the cross section layer by the combobox 702. The user defined table P-Plain-Encro can be exported to text file, whose file name will be listed in the textbox 704 by clicking the Browse Button 703. The directory of the output boundary shape file will be listed in the textbox 706 by clicking the Browse button 705. The file name of the boundary shape file can be specified in textbox 707. The tolerance of cross section comparison will be listed in textbox 708. Clicking the OK button 709 will make the function proceed to do the calculation communicating with the spreadsheet application. After clicking the Cancel button 710, the function will exit.

Figure 7B:
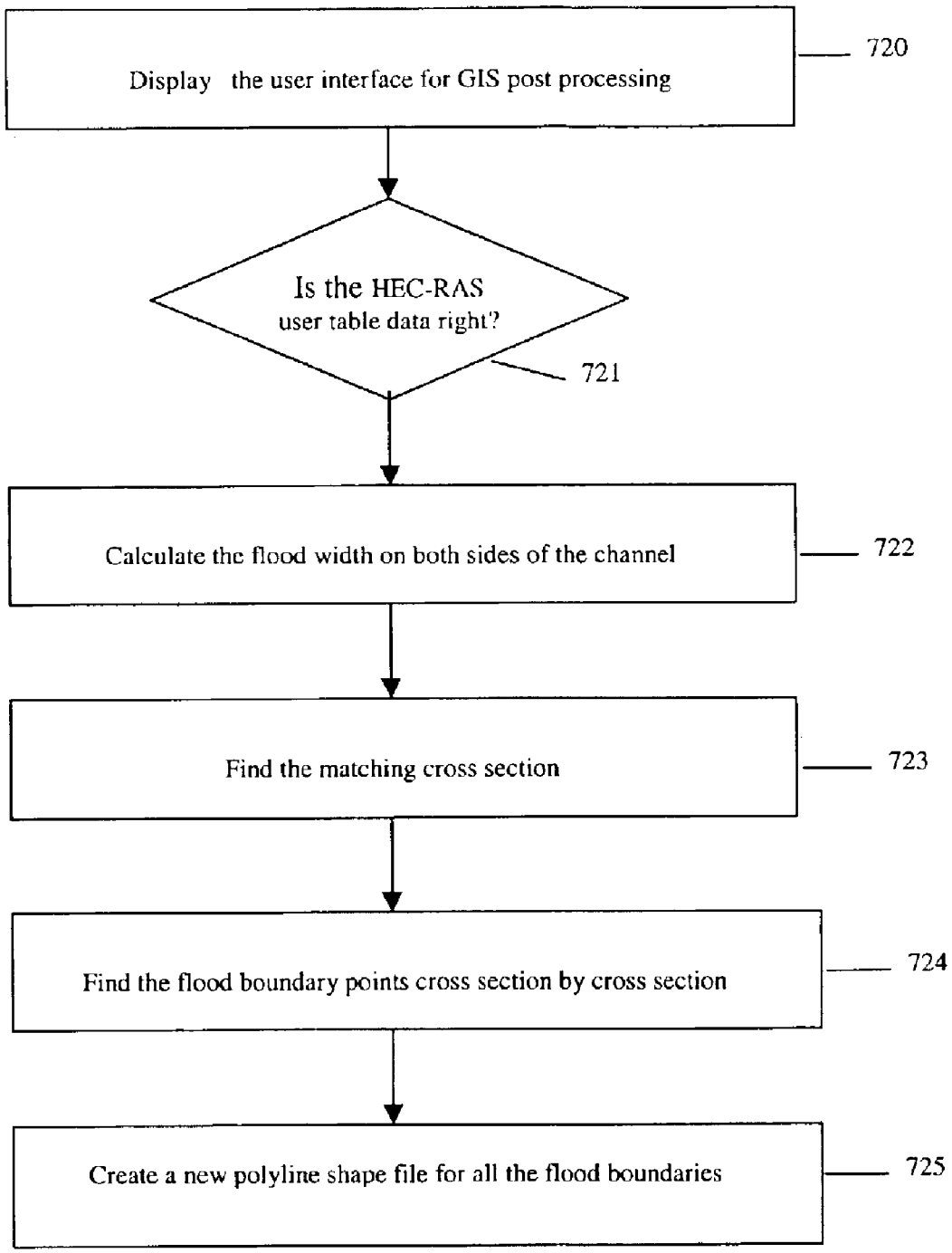
FIG. 7B illustrates a flow diagram of a process for GIS Post-Processor.

FIG. 7B illustrates a flow diagram of a process for the GIS Post-Processor. For explanation purpose, the steps of FIG. 7B will be described in reference to the components of FIG. 7A.

At step 720, a user interface is displayed to allow the user to interpolate flow. For example, the user may be presented with a user interface 700 as previously described in FIG. 7A.

At step 721, a determination is made by checking whether the format of the text file exported from the user defined HEC-RAS table is right. If the data is not right, the function will prompt the user the problem and go back to step 720; If everything is right, the function will proceed to step 722 to calculate the boundary width on both sides for each profile.

At step 723, the function finds the corresponding cross section in the cross section shape file based on the cross section name from the HEC-RAS user table. Using the boundary width, the creek centerline shape file and the cross section line found, the function performs the interpolation or extrapolation to map the boundary points on each cross section for each profile at step 724.

At step 725, the function creates a new polyline shape file, and stores the boundary lines created by connecting the generated boundary points in it.

In describing certain embodiments of the invention, several drawing figures have been used for explanation purposes. However, the invention is not limited to any particular context as shown in drawing figures, and the spirit and scope of the invention include other contexts and applications in which the hydraulics and hydrology of watersheds described herein may be used. Thus, the specification and drawings are, accordingly, to be regarded in an illustrative rather than a restrictive sense.

In addition, in this disclosure, including in the claims, certain process steps are set forth in a particular order, and alphabetic and alphanumeric labels are used to identify certain steps. For example, the order of inputting data on the user form and inputting data on the spreadsheet may be reversed. Thus, unless specifically stated in the disclosure, embodiments of the invention are not limited to any particular order of carrying out such steps. In particular, the labels are used merely for convenient identification of steps, and are not intended to imply, specify or require a particular order of carrying out such steps.

We claim:

1. A method to flexibly calculate hydraulics and hydrology of watersheds automatically comprising the steps reading in survey data automatically by a computer module to create new point shape files and polyline shape files;

calculating hydrology parameters by a computer module to prepare the input data for HEC-HMS program;

converting the spreadsheets containing the required hydrology parameters to the basin file and DSS database of HEC-HMS program by a computer module;

calculating the hydraulic parameters by a computer module to prepare the input data for HEC-RAS program; and mapping the floodplain and floodway boundary by a computer module based on the widths calculated by HEC-RAS program.

2. The method recited in claim 1, wherein the step of reading in survey data automatically by a computer module to create new point shape files and polyline shape files includes the steps:

validating the survey data and put the survey data in comma or space separated text file; and reading survey points from the text file into GIS based on their numerical coordinates and align them along the best fit lines through all the points contained in one cross section.

3. The method recited in claim 1, wherein the step of calculating hydrology parameters by a computer module to prepare the input data for HEC-HMS program includes the steps:

calculating slope and conveyance in every reach of channels from HEC-RAS result automatically by user specifying the starting and ending station numbers of reaches on a spreadsheet;

calculating cumulative area and development percentage from HEC-HMS basin file automatically by user filling in or linking the drainage area and development percentage for each subbasin on a spreadsheet;

calculating conveyance flow rates from a database built from engineering charts automatically by user filling in or linking the area, slope, and development percentage on a spreadsheet;

calculating storage-outflow relationship for selected reaches of channels from HEC-RAS result automatically by user specifying the starting and ending station numbers of reaches on a spreadsheet; and importing gage data from a spreadsheet automatically into the HEC-HMS DSS database and assign a unique name to that gage by combining the actual gage name the storm date.

4. The method recited in claim 3, wherein the step of calculating slope and conveyance in every reach of channels from HEC-RAS result automatically by user specifying the starting and ending station numbers of reaches on a spreadsheet includes the steps:

defining the user table in HEC-RAS program for slope and conveyance calculation, the table contains five columns: Reach, River Station, Minimum Channel Elevation, Flow Rate Percentage Channel, and Cumulative Channel Length;

filling in input data on an existing or new spreadsheet with three columns: Reach Name, HEC-RAS Cross Section NO., and HEC-HMS Node Name;

getting the table data either by communicating with the HEC-RAS program or by from a text file to which the HEC-RAS table is exported manually; and clicking start button to run the function and the result will be a on a new spreadsheet reach by reach with columns: Stations; Average Slope, and Percentage Flow in Main Channel for profiles.

5. The method recited in claim 3, wherein the step of calculating cumulative area and development percentage from HEC-HMS basin file automatically by user filling in or linking the drainage area and development percentage for each subbasin on a spreadsheet includes the steps:

filling in input data on an existing or new spreadsheet with four columns: Subbasin Name, Subbasin Area, Subbasin Development Percentage and Corresponding HEC-HMS Node Name;

selecting the HEC-HMS basin file name to be used as the connection scheme of all the components; and clicking start button to run the function and the result will be a on the right side of the same spreadsheet with columns: Subbasin Name, Corresponding HEC-HMS Node, Cumulative Area, and Cumulative Development Percentage.

6. The method recited in claim 3, wherein the step of calculating storage-outflow relationship for selected reaches of channels from HEC-RAS result automatically by user specifying the starting and ending station numbers of reaches on a spreadsheet includes the steps:

defining the user table in HEC-RAS program for storage-outflow calculation, the table contains five columns: Reach, River Station, Flow Rate Total, Volume, and Travel Time Average;

filling in input data on an existing or new spreadsheet with three columns: Reach Name, HEC-RAS Cross Section NO., and HEC-HMS Node Name;

getting the table data either by communicating with the HEC-RAS program or by a text file to which the HEC-RAS table is exported manually and specify the HEC-HMS time step interval; and clicking start button to run the function and the result will be a on a new spreadsheet reach by reach with columns: Storage, Out Flow, travel time for each profile, and average travel time steps for all profiles.

7. The method recited in claim 3, wherein the step of importing gage data from a spreadsheet automatically into the HEC-HMS DSS database and assign a unique name to that gage by combining the actual gage name the storm date includes the steps of:

filling in input data on an existing or new spreadsheet with four columns: Gage ID, Date, Time and Gage Data;

selecting the DSS database file and fill in the DSS path information on the user form; and clicking start button to run the function and the rainfall data will be stored in the DSS database and a unique gage ID will be stored in a text file associated with the HEC-HMS project.

8. The method recited in claim 1, wherein the step of converting the spreadsheets containing the required hydrology parameters to the basin file and DSS database of HEC-HMS program by a computer module includes the steps:

converting the input data on the formatted spreadsheets provided by the function to a HEC-HMS basin file and DSS database automatically;

aligning the basin components to the GIS coordinates or the averaged basin coordinates automatically; and cleaning the HEC-HMS project automatically so that it is ready to be deployed by using the relative file directory.

9. The method recited in claim 8, wherein the step of converting the input data on the formatted spreadsheets provided by the function to a HEC-HMS basin file and DSS database automatically includes the steps:

filling in input data on an existing or new workbook with four spreadsheets: Basins sheet containing subbasin parameters, Reaches sheet containing reach name and routing steps, Reservoirs sheet containing reservoir name and routing methods., and DSS Tables sheet containing the Storage Volume-Out Flow Rate, Storage Elevation-Storage Volume-Out Flow Rate, Diversion-Diverted Flow relationship data;

selecting the HEC-HMS basin file and DSS database file; and clicking start button to run the function and all the data on the spreadsheets will be appended to, overwrite or be inserted to the selected HEC-HMS basin file and DSS database.

10. The method recited in claim 1, wherein the step of calculating the hydraulic parameters by a computer module to prepare the input data for HEC-RAS program includes the steps:

retrieving the drainage area and peak flows at any HEC-HMS components automatically by user specifying the component name and HEC-HMS run name on a spreadsheet;

extrapolating flows based on drainage area for any cross section beyond the most upstream hydrology node automatically by user filling in or linking the known area and flow rates on a spreadsheet; and interpolating flows by user specified criteria based on river length for any cross section between hydrology nodes automatically by user filling in the known river station number and flow rates on a spreadsheet.

11. The method recited in claim 10, wherein the step of retrieving the drainage area and peak flows at any HEC-HMS components automatically by user specifying the component name and HEC-HMS run name on a spreadsheet includes the steps:

filling in input data on an existing or new spreadsheet with two columns: HMS-Runs, HEC-HMS Node Locations;

selecting the HEC-HMS basin file, DSS database file and HEC-HMS control time interval on the user form; and clicking start button to run the functions and the result will be on the right side of the same spreadsheet for each selected node location with columns: Node Name, Area, and peak flow for each selected run.

12. The method recited in claim 10, wherein the step of extrapolating flows based on drainage area for any cross section beyond the most upstream hydrology node automatically by user filling in or linking the known area and flow rates on a spreadsheet includes the steps:

filling in input data on an existing or new spreadsheet with columns: Stations needed to Extrapolate Flow, Drainage Area to This Point, Drainage Area at Hydrology Nodes, Peak Flows for Each Storms;

selecting the total number of storm frequencies to be extrapolated on the user form; and clicking start button to run the functions and the result will be on the right side of the same spreadsheet for each cross section to be extrapolated for peak flows with columns: Station No., Area, and peak flow for each storm frequency.

13. The method recited in claim 10, wherein the step of interpolating flows by user specified criteria based on river length for any cross section between hydrology nodes automatically by user filling in the known river station number and flow rates on a spreadsheet includes the steps:

filling in input data on an existing or new spreadsheet with columns: Stations needed to Interpolate Flow, Hydrology Node Name, Station Number of that Node, Peak Flows for Each Storms;

selecting the total number of storm frequencies to be interpolated and a selection criteria based on flow rate difference on the user form; and clicking start button to run the functions and the result will be on the right side of the same spreadsheet for each cross section to be interpolated for peak flows with columns: Station No., peak flow for each storm frequency, and flow rate difference between any two adjacent cross sections; and providing further result of the selected cross sections on the far right side of the same spreadsheet following the specified selection criteria with columns: Node Name, Station Number, peak flow for each storm frequency, and flow rate difference between any two adjacent selected cross sections.

14. The method recited in claim 1, wherein the step of mapping the floodplain and floodway boundary by a computer module based on the widths calculated by HEC-RAS program includes the steps:

processing the formatted HEC-RAS result and calculating the left width and right width based on the center, left and right station numbers; and Interpolating or extrapolating the boundary points in the cross sections by matching the calculated width and the cross section name in the GIS cross-section shape file automatically.

15. The method recited in claim 1, further comprising:

filling in or linking the input data on a user function form or preformatted spreadsheets provided by the function;

validating the user input format and data following engineering concepts and computation rules automatically by the function;

retrieving the validated data from the active spreadsheet, workbook or other user specified data sources like database and text file automatically by the function;

finishing the calculation and promote any errors automatically; and placing the calculated result on the spreadsheets, GIS shape files or text files by the function automatically.

16. An optimized system to flexibly calculate hydraulics and hydrology for watersheds automatically comprising:

a control module named GIS PRE-PROCESSOR operative to read in survey data automatically to create new point shape files and polyline shape files;

a control module named HEC-HMS PRE-PROCESSOR operative to calculate hydrology parameters to prepare the input data for HEC-HMS program;

a control module named HMS INPUT CONVERTER operative to convert the spreadsheets containing the required hydrology parameters to the basin file and DSS database of HEC-HMS program;

a control module named HEC-RAS PRE-PROCESSOR operative to calculate the hydraulic parameters to prepare the input data for HEC-RAS program; and a control module named GIS POST-PROCESSOR operative to map the floodplain and floodway boundary based on the widths calculated by HEC-RAS program.

* * * * *